US009219972B2

(12) United States Patent
Vilermo et al.

(10) Patent No.: US 9,219,972 B2
(45) Date of Patent: Dec. 22, 2015

(54) EFFICIENT AUDIO CODING HAVING REDUCED BIT RATE FOR AMBIENT SIGNALS AND DECODING USING SAME

(71) Applicant: Nokia Corporation, Espoo (FI)

(72) Inventors: Miikka T. Vilermo, Siuro (FI); Mikko T. Tammi, Tampere (FI)

(73) Assignee: Nokia Technologies Oy, Espoo (FI)

( * ) Notice: Subject to any disclaimer, the term of this patent is extended or adjusted under 35 U.S.C. 154(b) by 623 days.

(21) Appl. No.: 13/625,221

(22) Filed: Sep. 24, 2012

(65) Prior Publication Data

US 2014/0086414 A1 Mar. 27, 2014

(51) Int. Cl.

| | |
|---|---|
| ***H04S 3/00*** | (2006.01) |
| ***G10L 19/008*** | (2013.01) |
| *H04R 3/00* | (2006.01) |

(52) U.S. Cl.

CPC ..... *H04S 3/008* (2013.01); *G10L 19/008* (2013.01); *H04R 3/005* (2013.01); *H04S 3/004* (2013.01); *H04S 2400/01* (2013.01); *H04S 2400/07* (2013.01); *H04S 2400/15* (2013.01); *H04S 2420/01* (2013.01); *H04S 2420/03* (2013.01)

(58) Field of Classification Search

None

See application file for complete search history.

(56) References Cited

U.S. PATENT DOCUMENTS

| | | | | |
|---|---|---|---|---|
| 8,255,228 | B2 * | 8/2012 | Hilpert et al. | 704/500 |
| 2009/0319278 | A1 | 12/2009 | Yoon et al. | 704/500 |
| 2010/0030563 | A1 * | 2/2010 | Uhle et al. | 704/500 |
| 2012/0128174 | A1 * | 5/2012 | Tammi et al. | 381/92 |

FOREIGN PATENT DOCUMENTS

| | | |
|---|---|---|
| EP | 2 312 851 A2 | 4/2011 |

OTHER PUBLICATIONS

A. Liveris et al, Compression of Binary Sources with Side Information at the Decoder Using LDPC Codes, IEEE Communications Letters, vol. 6, No. 10, Oct. 2002.

L.Mainard et al, "The Modulated Phasor Transforms", Presented at the 99th Convention Oct. 6-9, 1995 New York. An Audio Engineering Society Preprint.

"Dolby Atmos Next-Generation Audio for Cinema", white paper, downloaded on Aug. 15, 2012 from http://www.google.com/url?sa=t&rct=j&q=&esrc=s&source=web&cd=1&sqi=2&ved=0CEUQFjAA&url=http%3A%2F%2Fwww.cinemaequip.com%2Ffiles%2F2012%2F07%2FDolby-Atmos-Next-Generation-Audio-for-cinema2.pdf&ei=Mb0rULeVB6iC6AHy8oGICg&usg=AFQjCNE_r4KgLzRTCFJ7QjRttAfuAH0B8w&sig2=zqJt4SYj0K6jyIobQofTsw&cad=rja.

(Continued)

*Primary Examiner* — Curtis Kuntz
*Assistant Examiner* — Kenny Truong
(74) *Attorney, Agent, or Firm* — Harrington & Smith

(57) ABSTRACT

An apparatus creates first data stream(s) by processing first audio signal(s) and creates second data stream(s) by processing second audio signal(s). The processing includes detecting phase information from at least one of the second audio signal(s) so as to eliminate the phase information. The second data stream(s) are created without the phase information from the at least one second audio signal. The first and second data streams are output. Another apparatus receives first data stream(s) including first audio signal(s) and receives second data stream(s) including second audio signal(s). The second audio signal(s) include at least one second audio signal where phase information has been eliminated. Phase information is detected from one of a selected first audio signal or a selected second audio signal and is added into the at least one second audio signal. Output audio is rendered using the first and second audio signal(s).

21 Claims, 16 Drawing Sheets

(56) References Cited

OTHER PUBLICATIONS

S. Mehrotra et al., "Low Bitrate Audio Coding Using Generalized Adaptive Gain Shape Vector Quantization Across Channels", Acoustics, Speech and Signal Processing, 2009. ICASSP 2009. IEEE International Conference: Apr. 19-24, 2009.

ISO/IEC 14496-3:2001(E), Information technology—Generic coding of moving pictures and associated audio information—Part 7: Advanced Audio Coding (AAC).

A. Seefeldt et al, "New Techniques in Spatial Audio Coding", Audio Engineering Society Convention Paper 6587 presented at the 119$^{th}$ Convention Oct. 7-10, 2005 New York, NY.

E. Schuijers et al., "Advances in Parametric Coding for High-Quality Audio", Audio Engineering Society, Convention Paper 5852, Presented at the 114$^{th}$ Convention, Mar. 22-25, 2003 Amsterdam.

J. Breebaart et al, "High Quality Parametric Spatial Audio Coding at Low Bitrates", May 2004, http://www.aes.org/e-lib/browse.cfm?elib+12760>.

D.Kim, "On the Perceptually Irrelevant Phase Information in Sinusoidal Representation of Speech", IEEE Transactions on Speech and Audio Processing, vol. 9, No. 8, Nov. 2001.

J. Nikunen et al., "Object-based Audio Coding Using Non-Negative Matrix Factorization for the Spectrogram Representation", Audio Engineering Society Convention Paper 8083, May 22-25, 2010, London, UK.

* cited by examiner

EFFICIENT AUDIO CODING HAVING REDUCED BIT RATE FOR AMBIENT SIGNALS AND DECODING USING SAME

CROSS-REFERENCE TO RELATED APPLICATIONS

The instant application is related to Ser. No. 12/927,663, filed on 19 Nov. 2010, entitled "Converting Multi-Microphone Captured Signals to Shifted Signals Useful for Binaural Signal Processing And Use Thereof", by the same inventors (Mikko T. Tammi and Miikka T. Vilermo) as the instant application; the instant application is related to Ser. No. 13/209,738, filed on 15 Aug. 2011, entitled "Apparatus and Method for Multi-Channel Signal Playback", by the same inventors (Mikko T. Tammi and Miikka T. Vilermo) as the instant application; the instant application is related to Ser. No. 13/365,468, filed on 3 Feb. 2012, entitled "A Controllable Playback System Offering Hierarchical Playback Options", by the same inventors (Mikko T. Tammi and Miikka T. Vilermo) as the instant application; each of these applications is incorporated by reference herein in its entirety.

TECHNICAL FIELD

This invention relates generally to microphone recording and signal playback based thereon and, more specifically, relates to processing multi-microphone captured signals and playback of the processed signals.

BACKGROUND

This section is intended to provide a background or context to the invention that is recited in the claims. The description herein may include concepts that could be pursued, but are not necessarily ones that have been previously conceived, implemented or described. Therefore, unless otherwise indicated herein, what is described in this section is not prior art to the description and claims in this application and is not admitted to be prior art by inclusion in this section.

Multiple microphones can be used to capture efficiently audio events. However, often it is difficult to convert the captured signals into a form such that the listener can experience the event as if being present in the situation in which the signal was recorded. Particularly, the spatial representation tends to be lacking, i.e., the listener does not sense the directions of the sound sources, as well as the ambience around the listener, identically as if he or she was in the original event.

One way to improve the spatial representation is by processing the multiple microphone signals into binaural signals. By using stereo headphones, the listener can (almost) authentically experience the original event upon playback of binaural recordings. Another way to improve the spatial representation is by processing the multiple microphone signals into multi-channel signals, such as 5.1 channels. Usually processing is possible to either binaural signals or multi-channel signals, but not both. Recently, however, it has become possible to process multiple microphone signals into either binaural signals or multi-channel signals, depending on user preference. Thus, a user has more control over how microphone signals should be processed.

In terms of taking audio signals from multiple microphones and creating multi-channel outputs, this was originally performed by creating the multiple channel outputs from the audio signals. For instance, sound engineers mixed audio signals to create 5.1 channels (where the "0.1" represents a sixth channel for low frequency effects), and those channels corresponded directly to the 5.1 multi-channel outputs. Thus, if binaural sound was desired, those 5.1 channels had to be processed into binaural channel outputs. Recently, however, there has been a trend toward creating more flexible audio formats. The term "flexible audio format" is used herein to express that a sound format can be rendered with any number of loudspeakers or with headphones. An example of these flexible audio formats is presented in Wiggins, B., "An Investigation into the Real-time Manipulation and Control of Three-dimensional Sound Fields", PhD thesis, University of Derby, Derby, UK (2004), which defines a "hierarchical" sound format as a format from which channels can be ignored resulting in less localization accuracy or added resulting in higher localization accuracy. Another example is Dolby Atmos, which is a new flexible audio format that creates flexibility with sound objects. More objects means a more complete sound scene, fewer objects means a less complete sound scene. Although exact details of Dolby Atmos have not been released, the company has released some information. In particular, according to the "Dolby Atmos Next-Generation Audio for Cinema", white paper:

"Audio objects can be considered as groups of sound elements that share the same physical location in the auditorium. Objects can be static or they can move. They are controlled by metadata that, among other things, details the position of the sound at a given point in time. When objects are monitored or played back in a theater, they are rendered according to the positional metadata using the speakers that are present, rather than necessarily being output to a physical channel."

According to the white paper, up to 128 tracks (e.g., each track corresponding to one or more microphone signals) can be processed into channel information (referred to as "beds") and into the previously described audio objects and corresponding positional metadata. The "beds" channel information may be added to the information from the audio objects. One use according to the white paper for the "beds" channel information is for ambient effects or reverberations.

In the mobile world, audio is often played back over many different kinds of speaker setups: mobile device integrated speakers, headphones, home speakers through a docking station, and the like. Therefore, a flexible audio format has great benefits in the mobile world. Unfortunately flexible audio formats usually require more bits to store and to transmit and in the mobile world there is less bandwidth and storage space available as compared to home or commercial locations. In particular, Dolby Atmos will consume a large amount of bandwidth. Therefore solutions that reduce the necessary bandwidth for flexible audio formats are very beneficial.

SUMMARY

This section is meant to provide an exemplary overview of exemplary embodiments of the instant invention.

An exemplary embodiment includes an apparatus, including one or more processors and one or more memories including computer program code. The one or more memories and the computer program code are configured, with the one or more processors, to cause the apparatus at least to: create one or more first data streams by processing one or more first audio signals; create one or more second data streams by processing one or more second audio signals, the processing the one or more second audio signals comprising detecting phase information from at least one of the one or more second audio signals so as to eliminate the phase information, wherein the one or more second data streams are created without the phase information from the at least one second audio signal; and output the one or more first data streams and the one or more second data streams.

Another exemplary embodiment is an apparatus including: means for creating one or more first data streams by processing one or more first audio signals; means for creating one or more second data streams by processing one or more second audio signals, the processing the one or more second audio signals comprising detecting phase information from at least one of the one or more second audio signals so as to eliminate the phase information, wherein the one or more second data streams are created without the phase information from the at least one second audio signal; and means for outputting the one or more first data streams and the one or more second data streams.

A further exemplary embodiment is a method that includes the following: creating one or more first data streams by processing one or more first audio signals; creating one or more second data streams by processing one or more second audio signals, the processing the one or more second audio signals comprising detecting phase information from at least one of the one or more second audio signals so as to eliminate the phase information, wherein the one or more second data streams are created without the phase information from the at least one second audio signal; and outputting the one or more first data streams and the one or more second data streams.

An additional exemplary embodiment includes a computer program product including a computer-readable storage medium bearing computer program code embodied therein for use with a computer. The computer program code includes the following: code for creating one or more first data streams by processing one or more first audio signals; code for creating one or more second data streams by processing one or more second audio signals, the processing the one or more second audio signals comprising detecting phase information from at least one of the one or more second audio signals so as to eliminate the phase information, wherein the one or more second data streams are created without the phase information from the at least one second audio signal; and code for outputting the one or more first data streams and the one or more second data streams.

An additional exemplary embodiment is an apparatus, including one or more processors and one or more memories including computer program code. The one or more memories and the computer program code are configured to, with the one or more processors, cause the apparatus at least to: receive one or more first data streams comprising one or more first audio signals; receive one or more second data streams comprising one or more second audio signals; detect phase information from one of a selected first audio signal or a selected second audio signal; add the phase information into the one or more second audio signals other than the selected second audio signal; and render output audio using the one or more first audio signals and the one or more second audio signals.

A further exemplary embodiment is an apparatus including the following: means for receiving one or more first data streams comprising one or more first audio signals; means for receiving one or more second data streams comprising one or more second audio signals; means for detecting phase information from one of a selected first audio signal or a selected second audio signal; means for adding the phase information into the one or more second audio signals other than the selected second audio signal; and means for rendering output audio using the one or more first audio signals and the one or more second audio signals.

Another exemplary embodiment is a method, including: receiving one or more first data streams comprising one or more first audio signals; receiving one or more second data streams comprising one or more second audio signals; detecting phase information from one of a selected first audio signal or a selected second audio signal; adding the phase information into the one or more second audio signals other than the selected second audio signal; and rendering output audio using the one or more first audio signals and the one or more second audio signals.

Yet another exemplary embodiment is a computer program product including a computer-readable storage medium bearing computer program code embodied therein for use with a computer. The computer program code includes the following: code for receiving one or more first data streams comprising one or more first audio signals; code for receiving one or more second data streams comprising one or more second audio signals; code for detecting phase information from one of a selected first audio signal or a selected second audio signal; code for adding the phase information into the one or more second audio signals other than the selected second audio signal; and code for rendering output audio using the one or more first audio signals and the one or more second audio signals.

BRIEF DESCRIPTION OF THE DRAWINGS

The foregoing and other aspects of embodiments of this invention are made more evident in the following Detailed Description of Exemplary Embodiments, when read in conjunction with the attached Drawing Figures, wherein.

DETAILED DESCRIPTION OF THE DRAWINGS

Figure 1:
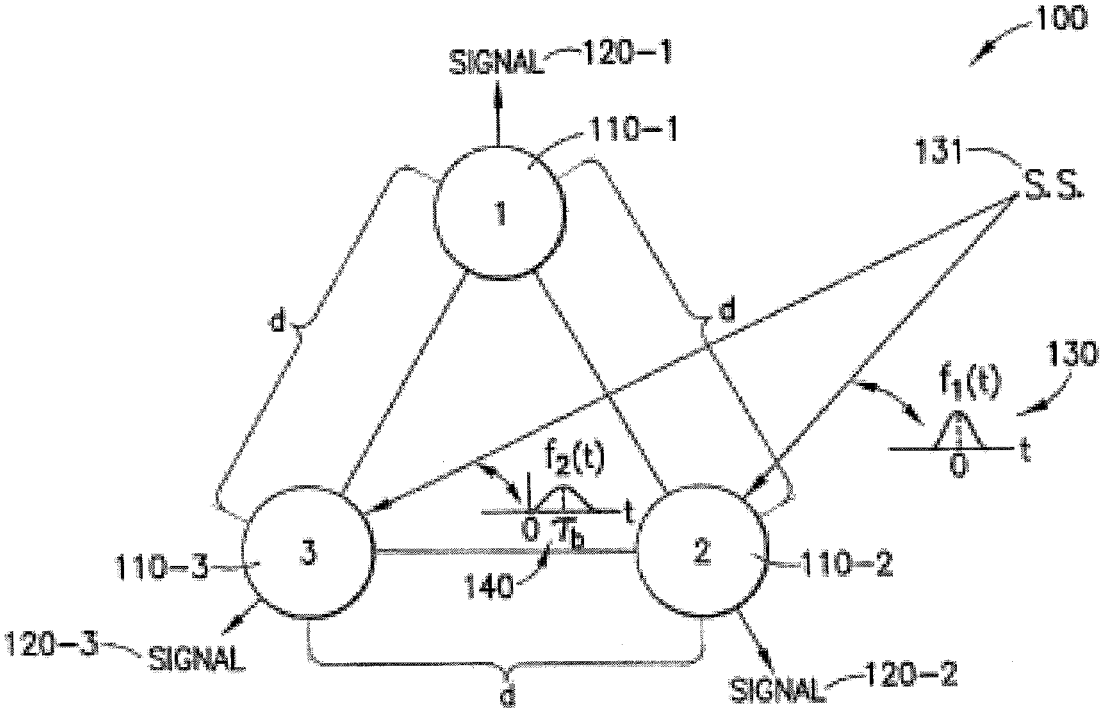
FIG. 1 shows an exemplary microphone setup using omnidirectional microphones.

As stated above, multiple separate microphones can be used to provide a reasonable facsimile of true binaural recordings. In recording studio and similar conditions, the microphones are typically of high quality and placed at particular predetermined locations. However, it is reasonable to apply multiple separate microphones for recording to less controlled situations. For instance, in such situations, the microphones can be located in different positions depending on the application:

1) In the corners of a mobile device such as a mobile phone;

2) In a headband or other similar wearable solution that is connected to a mobile device;

3) In a separate device that is connected to a mobile device or computer;

4) In separate mobile devices, in which case actual processing occurs in one of the devices or in a separate server; or 5) With a fixed microphone setup, for example, in a teleconference room, connected to a phone or computer.

Furthermore, there are several possibilities to exploit spatial sound recordings in different applications:

- Binaural audio enables mobile "3D" phone calls, i.e., "feel-what-I-feel" type of applications. This provides the listener a much stronger experience of "being there". This is a desirable feature with family members or friends when one wants to share important moments as make these moments as realistic as possible.
- Binaural audio can be combined with video, and currently with three-dimensional (3D) video recorded, e.g., by a consumer. This provides a more immersive experience to consumers, regardless of whether the audio/video is real-time or recorded.
- Teleconferencing applications can be made much more natural with binaural sound. Hearing the speakers in different directions makes it easier to differentiate speakers and it is also possible to concentrate on one speaker even though there would be several simultaneous speakers.
- Spatial audio signals can be utilized also in head tracking. For instance, on the recording end, the directional changes in the recording device can be detected (and removed if desired). Alternatively, on the listening end, the movements of the listener's head can be compensated such that the sounds appear, regardless of head movement, to arrive from the same direction.

As stated above, even with the use of multiple separate microphones, a problem is converting the capture of multiple (e.g., omnidirectional) microphones in known locations into good quality signals that retain the original spatial representation. This is especially true for good quality signals that may also be used as binaural signals, i.e., providing equal or near-equal quality as if the signals were recorded with an artificial head. Exemplary embodiments herein provide techniques for converting the capture of multiple (e.g., omnidirectional) microphones in known locations into signals that retain the original spatial representation. Techniques are also provided herein for modifying the signals into binaural signals, to provide equal or near-equal quality as if the signals were recorded with an artificial head.

The following techniques mainly refer to a system 100 with three microphones 100-1, 100-2, and 100-3 on a plane (e.g., horizontal level) in the geometrical shape of a triangle with vertices separated by distance, d, as illustrated in FIG. 1. However, the techniques can be easily generalized to different microphone setups and geometry. Typically, all the microphones are able to capture sound events from all directions, i.e., the microphones are omnidirectional. Each microphone 100 produces a typically analog signal 120.

The value of a 3D surround audio system can be measured using several different criteria. The most import criteria are the following:

1. Recording flexibility. The number of microphones needed, the price of the microphones (omnidirectional microphones are the cheapest), the size of the microphones (omnidirectional microphones are the smallest), and the flexibility in placing the microphones (large microphone arrays where the microphones have to be in a certain position in relation to other microphones are difficult to place on, e.g., a mobile device).

2. Number of channels. The number of channels needed for transmitting the captured signal to a receiver while retaining the ability for head tracking (if head tracking is possible for the given system in general): A high number of channels takes too many bits to transmit the audio signal over networks such as mobile networks.

3. Rendering flexibility. For the best user experience, the same audio signal should be able to be played over various different speaker setups: mono or stereo from the speakers of, e.g., a mobile phone or home stereos; 5.1 channels from a home theater; stereo using headphones, etc. Also, for the best 3D headphone experience, head tracking should be possible.

4. Audio quality. Both pleasantness and accuracy (e.g., the ability to localize sound sources) are important in 3D surround audio. Pleasantness is more important for commercial applications.

With regard to this criteria, exemplary embodiments of the instant invention provide the following:

1. Recording flexibility. Only omnidirectional microphones need be used. Only three microphones are needed. Microphones can be placed in any configuration (although the configuration shown in FIG. 1 is used in the examples below).

2. Number of channels needed. Two channels are used for higher quality. One channel may be used for medium quality.

3. Rendering flexibility. This disclosure describes only binaural rendering, but all other loudspeaker setups are possible, as well as head tracking.

4. Audio quality. In tests, the quality is very close to original binaural recordings and High Quality DirAC (directional audio coding).

In the instant invention, the directional component of sound from several microphones is enhanced by removing time differences in each frequency band of the microphone signals. In this way, a downmix from the microphone signals will be more coherent. A more coherent downmix makes it possible to render the sound with a higher quality in the receiving end (i.e., the playing end).

In an exemplary embodiment, the directional component may be enhanced and an ambience component created by using mid/side decomposition. The mid-signal is a downmix of two channels. It will be more coherent with a stronger directional component when time difference removal is used. The stronger the directional component is in the mid-signal, the weaker the directional component is in the side-signal. This makes the side-signal a better representation of the ambience component.

This description is divided into several parts. In the first part, the estimation of the directional information is briefly described. In the second part, it is described how the directional information is used for generating binaural signals from three microphone capture. Yet additional parts describe apparatus and encoding/decoding.

Directional Analysis

There are many alternative methods regarding how to estimate the direction of arriving sound. In this section, one method is described to determine the directional information. This method has been found to be efficient. This method is merely exemplary and other methods may be used. This method is described using FIGS. 2 and 3. It is noted that the flowcharts for FIGS. 2 and 3 (and all other figures having flowcharts) may be performed by software executed by one or more processors, hardware elements (such as integrated circuits) designed to incorporate and perform one or more of the operations in the flowcharts, or some combination of these.

A straightforward direction analysis method, which is directly based on correlation between channels, is now described. The direction of arriving sound is estimated independently for B frequency domain subbands. The idea is to find the direction of the perceptually dominating sound source for every subband.

Figure 2:
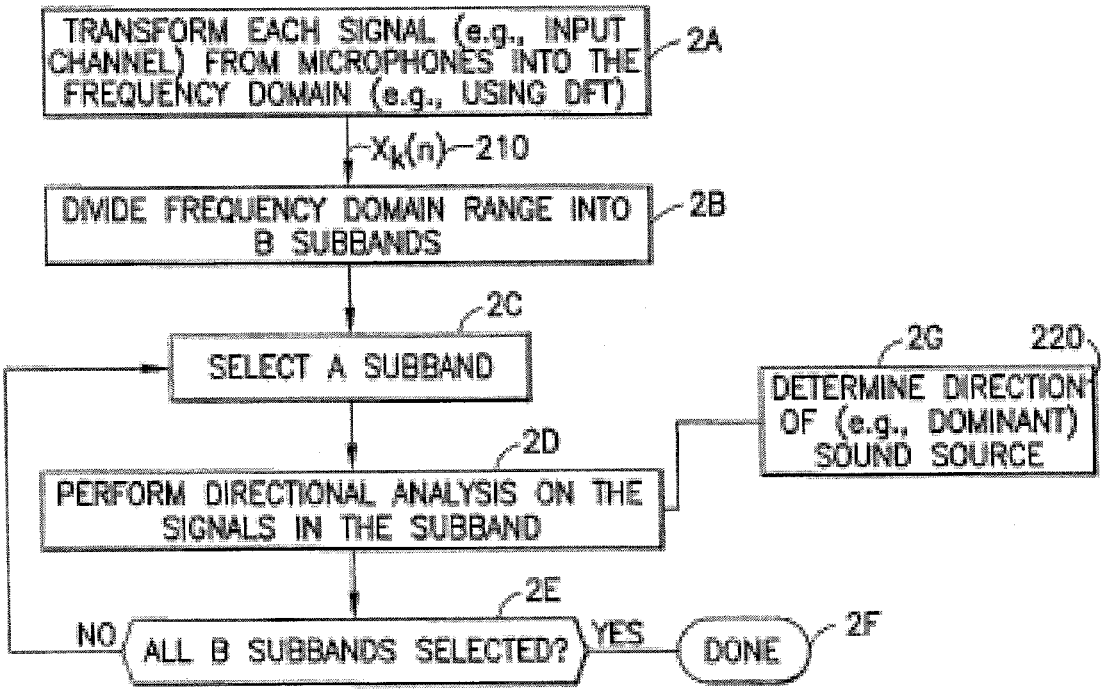
FIG. 2 is a block diagram of a flowchart for performing a directional analysis on microphone signals from multiple microphones.
Figure 3:
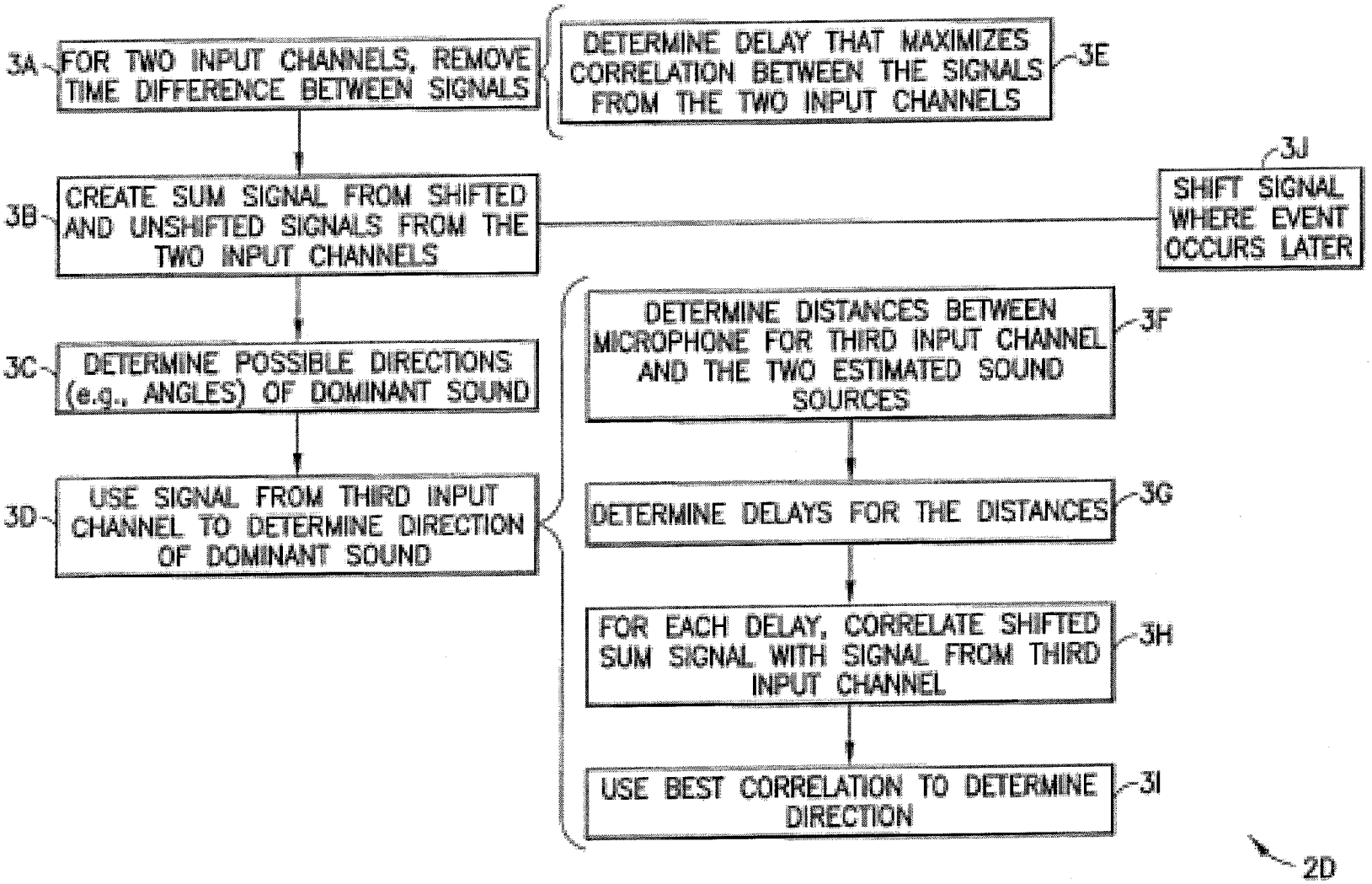
FIG. 3 is a block diagram of a flowchart for performing directional analysis on subbands for frequency-domain microphone signals.

Every input channel k=1, 2, 3 is transformed to the frequency domain using the DFT (discrete Fourier transform) (block 2A of FIG. 2). Each input channel corresponds to a signal 120-1, 120-2, 120-3 produced by a corresponding microphone 110-1, 110-2, 110-3 and is a digital version (e.g., sampled version) of the analog signal 120. In an exemplary embodiment, sinusoidal windows with 50 percent overlap and effective length of 20 ms (milliseconds) are used. Before the DFT transform is used, $D_{tot}=D_{max}+D_{HRTF}$ zeroes are added to the end of the window. $D_{max}$ corresponds to the maximum delay in samples between the microphones. In the microphone setup presented in FIG. 1, the maximum delay is obtained as $$D_{max} = \frac{dF_s}{v}, \tag{1}$$

where $F_s$ is the sampling rate of signal and v is the speed of the sound in the air. $D_{HRTF}$ is the maximum delay caused to the signal by HRTF (head related transfer functions) processing. The motivation for these additional zeroes is given later. After the DFT transform, the frequency domain representation $X_k(n)$ (reference 210 in FIG. 2) results for all three channels, k=1, . . . 3, n=0, . . . , N−1. N is the total length of the window considering the sinusoidal window (length $N_s$) and the additional $D_{tot}$ zeroes.

The frequency domain representation is divided into B subbands (block 2B)

$$X_k^b(n)=X_k(n_b+n), n=0, \ldots, n_{b+1}-n_b-1, b=0, \ldots, B-1, \tag{2}$$

where $n_b$ is the first index of bth subband. The widths of the subbands can follow, for example, the ERB (equivalent rectangular bandwidth) scale.

For every subband, the directional analysis is performed as follows. In block 2C, a subband is selected. In block 2D, directional analysis is performed on the signals in the subband. Such a directional analysis determines a direction 220 ($\alpha_b$ below) of the (e.g., dominant) sound source (block 2G). Block 2D is described in more detail in FIG. 3. In block 2E, it is determined if all subbands have been selected. If not (block 2B=NO), the flowchart continues in block 2C. If so (block 2E=YES), the flowchart ends in block 2F.

More specifically, the directional analysis is performed as follows. First the direction is estimated with two input channels (in the example implementation, input channels 2 and 3). For the two input channels, the time difference between the frequency-domain signals in those channels is removed (block 3A of FIG. 3). The task is to find delay $\tau_b$ that maximizes the correlation between two channels for subband b (block 3E). The frequency domain representation of, e.g., $X_k^b(n)$ can be shifted $\tau_b$ time domain samples using $$X_{k,\tau_b}^b(n) = X_k^b(n)e^{-j\frac{2\pi n\tau_b}{N}}. \tag{3}$$

Now the optimal delay is obtained (block 3E) from $$\max_{\tau_b} Re(\Sigma_{n=0}^{n_{b+1}-n_b-1}(X_{2,\tau_b}^b(n))), \tau_b \epsilon [-D_{max}, D_{max}] \tag{4}$$

where Re indicates the real part of the result and * denotes complex conjugate. $X_{2,\tau_b}^b$ and $X_3^b$ are considered vectors with length of $n_{b+1}-n_b-1$ samples. Resolution of one sample is generally suitable for the search of the delay. Also other perceptually motivated similarity measures than correlation can be used. With the delay information, a sum signal is created (block 3B). It is constructed using following logic $$X_{sum}^b = \begin{cases} (X_{2,\tau_b}^b + X_3^b)/2 & \tau_b \le 0 \\ (X_2^b + X_{3,-\tau_b}^b)/2 & \tau_b > 0, \end{cases} \tag{5}$$

where $\tau_b$ is the $\tau_b$ determined in equation (4).

In the sum signal the content (i.e., frequency-domain signal) of the channel in which an event occurs first is added as such, whereas the content (i.e., frequency-domain signal) of the channel in which the event occurs later is shifted to obtain the best match (block 3J).

Turning briefly to FIG. 1, a simple illustration helps to describe in broad, non-limiting terms, the shift $\tau_b$ and its operation above in equation (5). A sound source (S.S.) 131 creates an event described by the exemplary time-domain function $f_1(t)$ 130 received at microphone 2, 110-2. That is, the signal 120-2 would have some resemblance to the time-domain function $f_1(t)$ 130. Similarly, the same event, when received by microphone 3, 110-3 is described by the exemplary time-domain function $f_2(t)$ 140. It can be seen that the microphone 3, 110-3 receives a shifted version of $f_1(t)$ 130. In other words, in an ideal scenario, the function $f_2(t)$ 140 is simply a shifted version of the function $f_1(t)$ 130, where $f_2(t)=f_1(t-\tau T_b)$ 130. Thus, in one aspect, the instant invention removes a time difference between when an occurrence of an event occurs at one microphone (e.g., microphone 3, 110-3) relative to when an occurrence of the event occurs at another microphone (e.g., microphone 2, 110-2). This situation is described as ideal because in reality the two microphones will likely experience different environments, their recording of the event could be influenced by constructive or destructive interference or elements that block or enhance sound from the event, etc.

The shift $\tau_b$ indicates how much closer the sound source is to microphone 2, 110-2 than microphone 3, 110-3 (when $\tau_b$ is positive, the sound source is closer to microphone 2 than microphone 3). The actual difference in distance can be calculated as $$\Delta_{23} = \frac{v\tau_b}{F_s}. \tag{6}$$

Utilizing basic geometry on the setup in FIG. 1, it can be determined that the angle of the arriving sound is equal to (returning to FIG. 3, this corresponds to block 3C)

$$\dot{\alpha}_b = \pm\cos^{-1}\left(\frac{\Delta_{23}^2 + 2b\Delta_{23} - d^2}{2db}\right), \tag{7}$$

where d is the distance between microphones and b is the estimated distance between sound sources and nearest microphone. Typically b can be set to a fixed value. For example b=2 meters has been found to provide stable results. Notice that there are two alternatives for the direction of the arriving sound as the exact direction cannot be determined with only two microphones.

The third microphone is utilized to define which of the signs in equation (7) is correct (block 3D). An example of a technique for performing block 3D is as described in reference to blocks 3F to 3I. The distances between microphone 1 and the two estimated sound sources are the following (block 3F):

$$\delta_b^+ = \sqrt{(h + b\sin(\dot{\alpha}_b))^2 + (d/2 + b\cos(\dot{\alpha}_b))^2}$$

$$\delta_b^- = \sqrt{(h - b\sin(\dot{\alpha}_b))^2 + (d/2 + b\cos(\dot{\alpha}_b))^2}, \tag{8}$$

where h is the height of the equilateral triangle, i.e.

$$h = \frac{\sqrt{3}}{2}d. \tag{9}$$

The distances in equation (8) are equal to delays (in samples) (block 3G)

$$\tau_b^+ = \frac{\delta^+ - b}{v}F_s$$

$$\tau_b^- = \frac{\delta^- - b}{v}F_s. \tag{10}$$

Out of these two delays, the one is selected that provides better correlation with the sum signal. The correlations are obtained as (block 3H)

$$c_b^+ = Re(\Sigma_{n=0}^{nb+1-nb-1}(X_{sum,\tau_b^+}^b(n) * X_1^b(n)))$$

$$c_b^- = Re(\Sigma_{n=0}^{nb+1-nb-1}(X_{sum,\tau_b^-}^b(n) * X_1^b(n))). \tag{11}$$

Now the direction is obtained of the dominant sound source for subband b (block 3I):

$$\alpha_b = \begin{cases} \dot{\alpha}_b & c_b^+ \geq c_b^- \\ -\dot{\alpha}_b & c_b^+ < c_b^- \end{cases}. \tag{12}$$

The same estimation is repeated for every subband (e.g., as described above in reference to FIG. 2).

Binaural Synthesis

Figure 4:
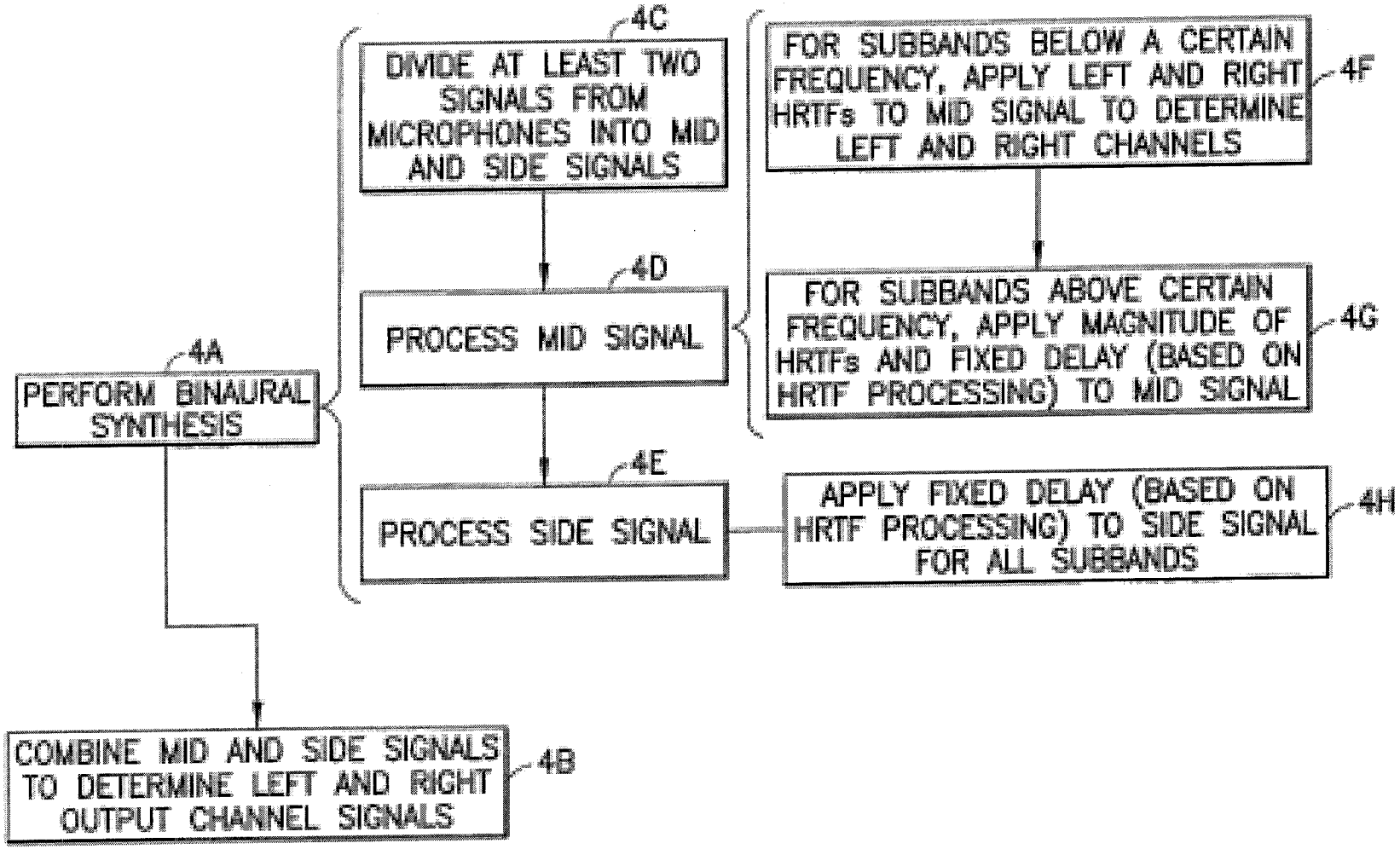
FIG. 4 is a block diagram of a flowchart for performing binaural synthesis and creating output channel signals therefrom.
Figure 5:
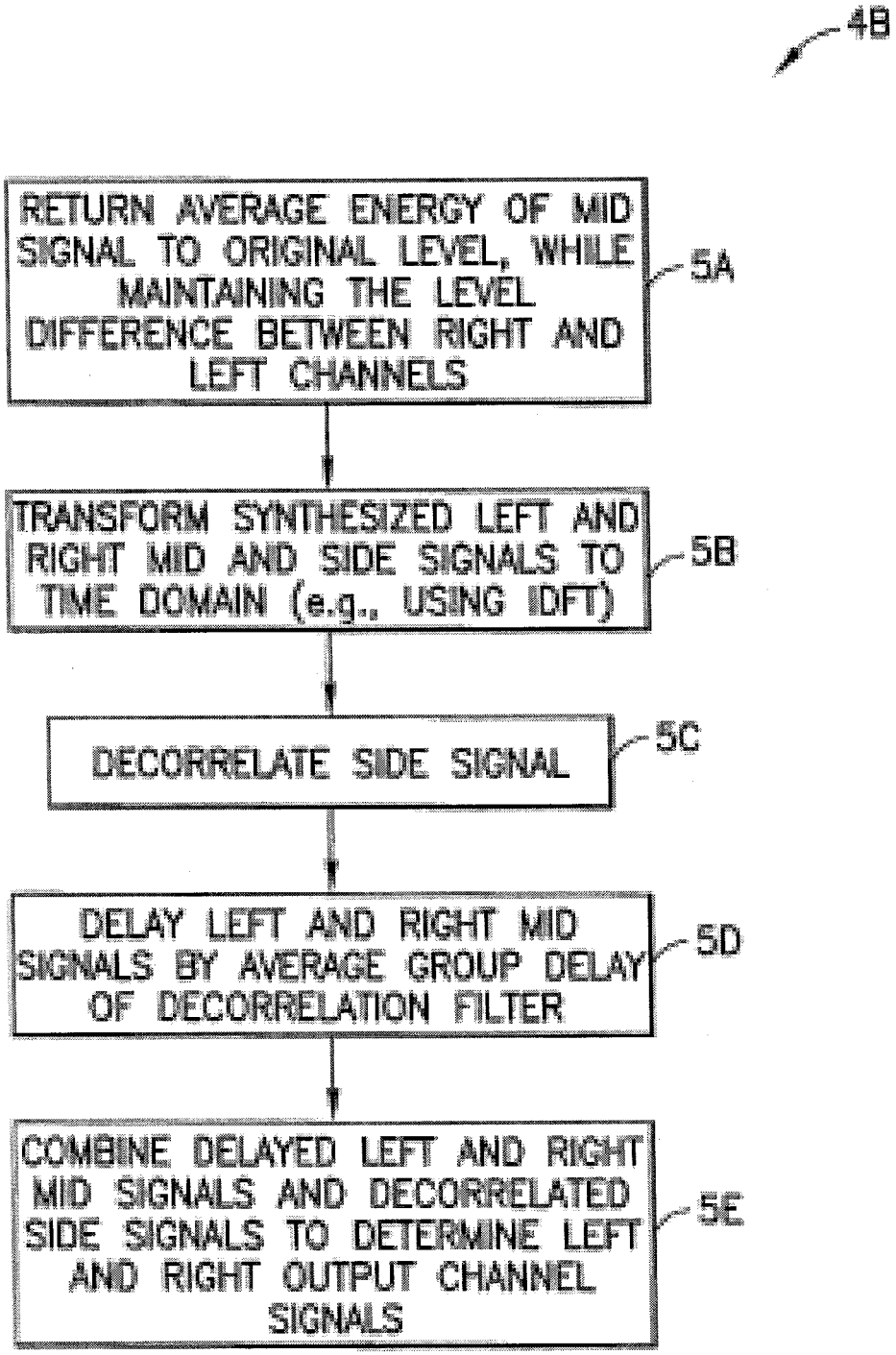
FIG. 5 is a block diagram of a flowchart for combining mid and side signals to determine left and right output channel signals.

With regard to the following binaural synthesis, reference is made to FIGS. 4 and 5. Exemplary binaural synthesis is described relative to block 4A. After the directional analysis, we now have estimates for the dominant sound source for every subband b. However, the dominant sound source is typically not the only source, and also the ambience should be considered. For that purpose, the signal is divided into two parts (block 4C): the mid and side signals. The main content in the mid signal is the dominant sound source which was found in the directional analysis. Respectively, the side signal mainly contains the other parts of the signal. In an exemplary proposed approach, mid and side signals are obtained for subband b as follows:

$$M^b = \begin{cases} (X_{2,\tau_b}^b + X_3^b)/2 & \tau_b \leq 0 \\ (X_2^b + X_{3,-\tau_b}^b)/2 & \tau_b > 0 \end{cases}, \tag{13}$$

$$S^b = \begin{cases} (X_{2,\tau_b}^b - X_3^b)/2 & \tau_b \leq 0 \\ (X_2^b - X_{3,-\tau_b}^b)/2 & \tau_b > 0 \end{cases}. \tag{14}$$

Notice that the mid signal $M^b$ is actually the same sum signal which was already obtained in equation (5) and includes a sum of a shifted signal and a non-shifted signal. The side signal $S^b$ includes a difference between a shifted signal and a non-shifted signal. The mid and side signals are constructed in a perceptually safe manner such that, in an exemplary embodiment, the signal in which an event occurs first is not shifted in the delay alignment (see, e.g., block 3J, described above). This approach is suitable as long as the microphones are relatively close to each other. If the distance between microphones is significant in relation to the distance to the sound source, a different solution is needed. For example, it can be selected that channel 2 is always modified to provide best match with channel 3.

Mid Signal Processing

Mid signal processing is performed in block 4D. An example of block 4D is described in reference to blocks 4F and 4G. Head related transfer functions (HRTF) are used to synthesize a binaural signal. For HRTF, see, e.g., B. Wiggins, "An Investigation into the Real-time Manipulation and Control of Three Dimensional Sound Fields", PhD thesis, University of Derby, Derby, UK, 2004. Since the analyzed directional information applies only to the mid component, only that is used in the HRTF filtering. For reduced complexity, filtering is performed in frequency domain. The time domain impulse responses for both ears and different angles, $h_{L,\alpha}(t)$ and $h_{R,\alpha}(t)$, are transformed to corresponding frequency domain representations $H_{L,\alpha}(n)$ and $H_{R,\alpha}(n)$ using DFT. Required numbers of zeroes are added to the end of the impulse responses to match the length of the transform window (N). HRTFs are typically provided only for one ear, and the other set of filters are obtained as mirror of the first set.

HRTF filtering introduces a delay to the input signal, and the delay varies as a function of direction of the arriving sound. Perceptually the delay is most important at low frequencies, typically for frequencies below 1.5 kHz. At higher frequencies, modifying the delay as a function of the desired sound direction does not bring any advantage, instead there is a risk of perceptual artifacts. Therefore different processing is used for frequencies below 1.5 kHz and for higher frequencies.

For low frequencies, the HRTF filtered set is obtained for one subband as a product of individual frequency components (block 4F):

$$\tilde{M}_L^b(n)=M^b(n)H_{L,\alpha_b}(n_b+n), n=0, \ldots, n_{b+1}-n_b-1,$$

$$\tilde{M}_R^b(n)=M^b(n)H_{R,\alpha_b}(n_b+n), n=0, \ldots, n_{b+1}-n_b-1. \quad (15)$$

The usage of HRTFs is straightforward. For direction (angle) β, there are HRTF filters for left and right ears, $HL_\beta(z)$ and $HR_\beta(z)$, respectively. A binaural signal with sound source S(z) in direction β is generated straightforwardly as $L(z)=HL_\beta(z)S(z)$ and $R(z)=HR_\beta(z)S(z)$, where L(z) and R(z) are the input signals for left and right ears. The same filtering can be performed in DFT domain as presented in equation (15). For the subbands at higher frequencies the processing goes as follows (block 4G) (equation 16):

$$\tilde{M}_L^b(n) = M^b(n)|H_{L,\alpha_b}(n_b+n)|e^{-j\frac{2\pi(n+n_b)\tau_{HRTF}}{N}}, n = 0, \ldots, n_{b+1}-n_b-1,$$

$$\tilde{M}_R^b(n) = M^b(n)|H_{R,\alpha_b}(n_b+n)|e^{-j\frac{2\pi(n+n_b)\tau_{HRTF}}{N}}, n = 0, \ldots, n_{b+1}-n_b-1.$$

It can be seen that only the magnitude part of the HRTF filters are used, i.e., the delays are not modified. On the other hand, a fixed delay of $\tau_{HRTF}$ samples is added to the signal. This is used because the processing of the low frequencies (equation (15)) introduces a delay to the signal. To avoid a mismatch between low and high frequencies, this delay needs to be compensated. $\tau_{HRTF}$ is the average delay introduced by HRTF filtering and it has been found that delaying all the high frequencies with this average delay provides good results. The value of the average delay is dependent on the distance between sound sources and microphones in the used HRTF set.

Side Signal Processing

Processing of the side signal occurs in block 4E. An example of such processing is shown in block 4H. The side signal does not have any directional information, and thus no HRTF processing is needed. However, delay caused by the HRTF filtering has to be compensated also for the side signal. This is done similarly as for the high frequencies of the mid signal (block 4H):

$$\tilde{S}^b(n) = S^b(n)e^{-j\frac{2\pi(n+n_b)\tau_{HRTF}}{N}}, n = 0, \ldots, n_{b+1}-n_b-1. \quad (17)$$

For the side signal, the processing is equal for low and high frequencies.

Combining Mid and Side Signals

In block 4B, the mid and side signals are combined to determine left and right output channel signals. Exemplary techniques for this are shown in FIG. 5, blocks 5A-5E. The mid signal has been processed with HRTFs for directional information, and the side signal has been shifted to maintain the synchronization with the mid signal. However, before combining mid and side signals, there still is a property of the HRTF filtering which should be considered: HRTF filtering typically amplifies or attenuates certain frequency regions in the signal. In many cases, also the whole signal is attenuated. Therefore, the amplitudes of the mid and side signals may not correspond to each other. To fix this, the average energy of mid signal is returned to the original level, while still maintaining the level difference between left and right channels (block 5A). In one approach, this is performed separately for every subband.

The scaling factor for subband b is obtained as $$\varepsilon^b = \sqrt{\frac{2\left(\sum_{n=n_b}^{n_{b+1}-1}|M^b(n)|^2\right)}{\sum_{n=n_b}^{n_{b+1}-1}|\tilde{M}_L^b(n)|^2+\sum_{n=n_b}^{n_{b+1}-1}|\tilde{M}_R^b(n)|^2}}. \quad (18)$$

Now the scaled mid signal is obtained as:

$$\overline{M}_L^b=\epsilon^b\tilde{M}_L^b,$$

$$\overline{M}_R^b=\epsilon^b\tilde{M}_R^b. \quad (19)$$

Synthesized mid and side signals $\overline{M}_L$, $\overline{M}_R$ and $\tilde{S}$ are transformed to the time domain using the inverse DFT (IDFT) (block 5B). In an exemplary embodiment, $D_{tot}$ last samples of the frames are removed and sinusoidal windowing is applied. The new frame is combined with the previous one with, in an exemplary embodiment, 50 percent overlap, resulting in the overlapping part of the synthesized signals $m_L(t)$, $m_R(t)$ and s(t).

The externalization of the output signal can be further enhanced by the means of decorrelation. In an embodiment, decorrelation is applied only to the side signal (block 5C), which represents the ambience part. Many kinds of decorrelation methods can be used, but described here is a method applying an all-pass type of decorrelation filter to the synthesized binaural signals. The applied filter is of the form $$D_L(z) = \frac{\beta+z^{-P}}{1+\beta z^{-P}},$$

$$D_R(z) = \frac{-\beta+z^{-P}}{1-\beta z^{-P}}. \quad (20)$$

where P is set to a fixed value, for example 50 samples for a 32 kHz signal. The parameter β is used such that the parameter is assigned opposite values for the two channels. For example 0.4 is a suitable value for β. Notice that there is a different decorrelation filter for each of the left and right channels.

The output left and right channels are now obtained as (block 5E):

$$L(z)=z^{-P_D}M_L(z)+D_L(z)S(z)$$

$$R(z)=z^{-P_D}M_R(z)+D_R(z)S(z)$$

where $P_D$ is the average group delay of the decorrelation filter (equation (20)) (block 5D), and $M_L(z)$, $M_R(Z)$ and S(z) are z-domain representations of the corresponding time domains signals.

Exemplary System

Figure 6:
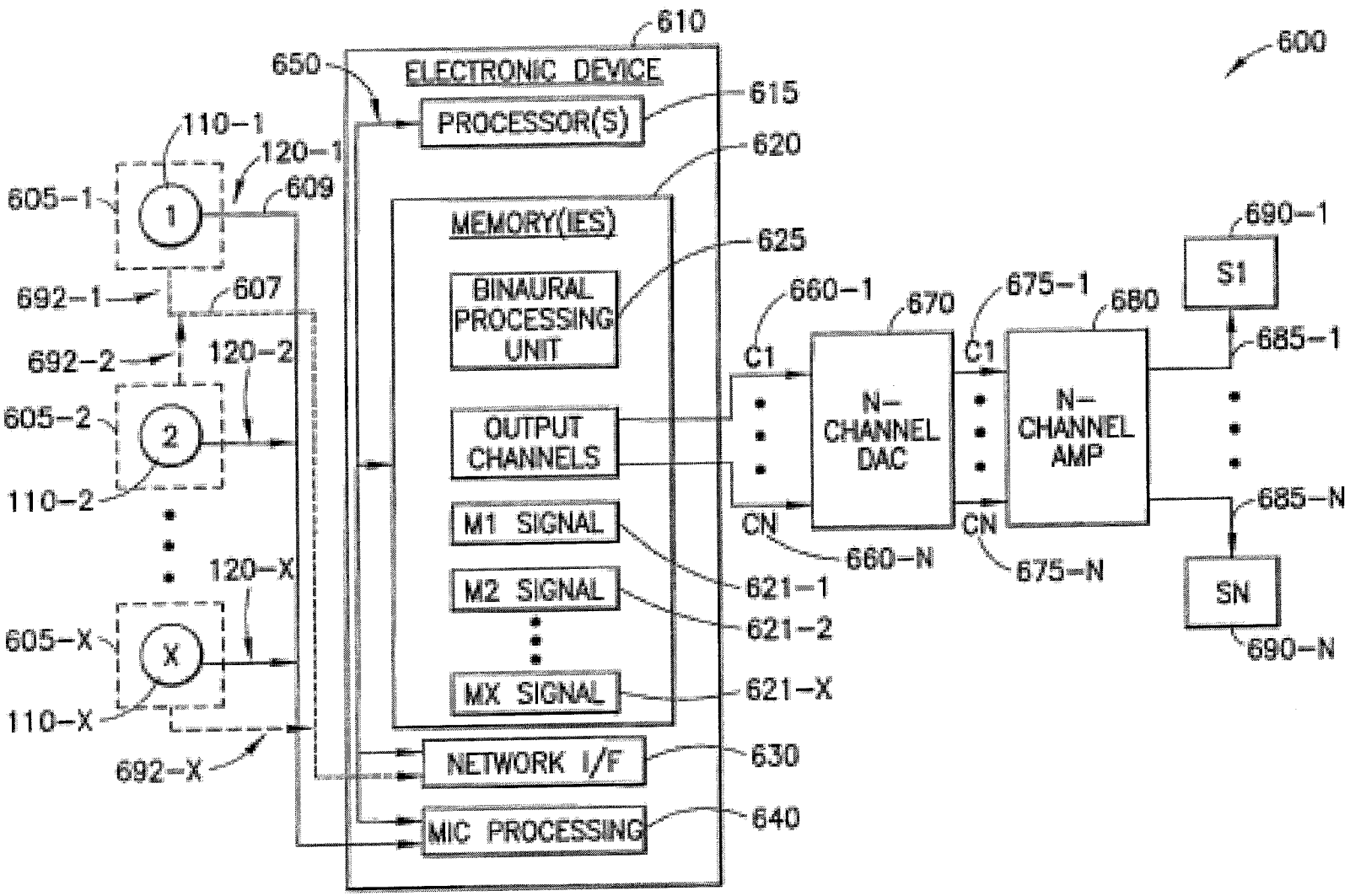
FIG. 6 is a block diagram of a system suitable for performing embodiments of the invention.

Turning to FIG. 6, a block diagram is shown of a system 600 suitable for performing embodiments of the invention. System 600 includes X microphones 110-1 through 110-X that are capable of being coupled to an electronic device 610 via wired connections 609. The electronic device 610 includes one or more processors 615, one or more memories 620, one or more network interfaces 630, and a microphone processing module 640, all interconnected through one or more buses 650. The one or more memories 620 include a binaural processing unit 625, output channels 660-1 through 660-N, and frequency-domain microphone signals M1 621-1 through MX 621-X. In the exemplary embodiment of FIG. 6, the binaural processing unit 625 contains computer program code that, when executed by the processors 615, causes the electronic device 610 to carry out one or more of the operations described herein. In another exemplary embodiment, the binaural processing unit or a portion thereof is implemented in hardware (e.g., a semiconductor circuit) that is defined to perform one or more of the operations described above.

In this example, the microphone processing module 640 takes analog microphone signals 120-1 through 120-X, converts them to equivalent digital microphone signals (not shown), and converts the digital microphone signals to frequency-domain microphone signals M1 621-1 through MX 621-X.

The electronic device 610 can include, but are not limited to, cellular telephones, personal digital assistants (PDAs), computers, image capture devices such as digital cameras, gaming devices, music storage and playback appliances, Internet appliances permitting Internet access and browsing, as well as portable or stationary units or terminals that incorporate combinations of such functions.

In an example, the binaural processing unit acts on the frequency-domain microphone signals 621-1 through 621-X and performs the operations in the block diagrams shown in FIGS. 2-5 to produce the output channels 660-1 through 660-N. Although right and left output channels are described in FIGS. 2-5, the rendering can be extended to higher numbers of channels, such as 5, 7, 9, or 11.

For illustrative purposes, the electronic device 610 is shown coupled to an N-channel DAC (digital to audio converter) 670 and an n-channel amp (amplifier) 680, although these may also be integral to the electronic device 610. The N-channel DAC 670 converts the digital output channel signals 660 to analog output channel signals 675, which are then amplified by the N-channel amp 680 for playback on N speakers 690 via N amplified analog output channel signals 685. The speakers 690 may also be integrated into the electronic device 610. Each speaker 690 may include one or more drivers (not shown) for sound reproduction.

The microphones 110 may be omnidirectional microphones connected via wired connections 609 to the microphone processing module 640. In another example, each of the electronic devices 605-1 through 605-X has an associated microphone 110 and digitizes a microphone signal 120 to create a digital microphone signal (e.g., 692-1 through 692-X) that is communicated to the electronic device 610 via a wired or wireless network 609 to the network interface 630. In this case, the binaural processing unit 625 (or some other device in electronic device 610) would convert the digital microphone signal 692 to a corresponding frequency-domain signal 621. As yet another example, each of the electronic devices 605-1 through 605-X has an associated microphone 110, digitizes a microphone signal 120 to create a digital microphone signal 692, and converts the digital microphone signal 692 to a corresponding frequency-domain signal 621 that is communicated to the electronic device 610 via a wired or wireless network 609 to the network interface 630.

Signal Coding

Proposed techniques can be combined with signal coding solutions. Two channels (mid and side) as well as directional information need to be coded and submitted to a decoder to be able to synthesize the signal. The directional information can be coded with a few kilobits per second.

Figure 7:
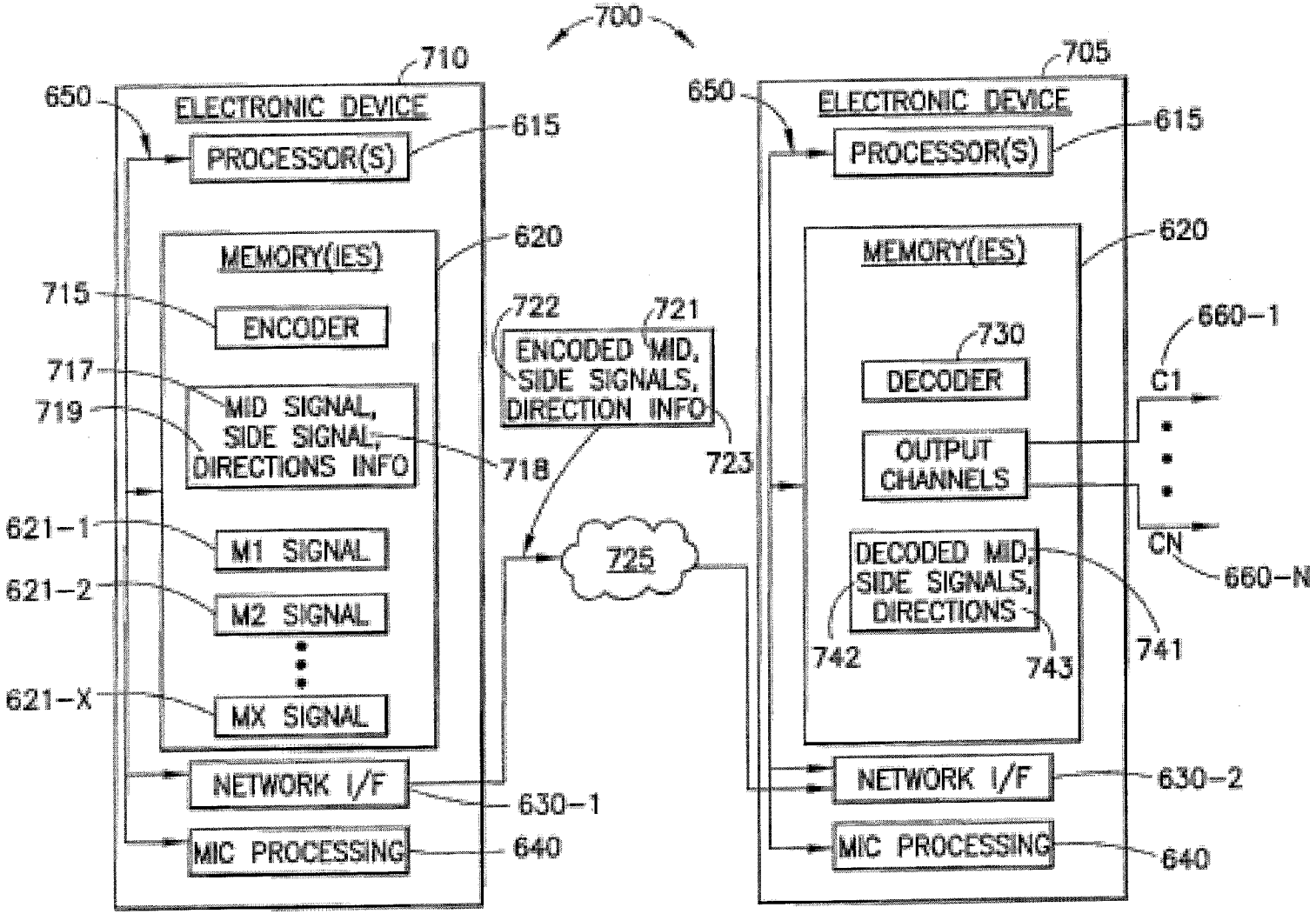
FIG. 7 is a block diagram of a second system suitable for performing embodiments of the invention for signal coding aspects of the invention.
Figure 9:
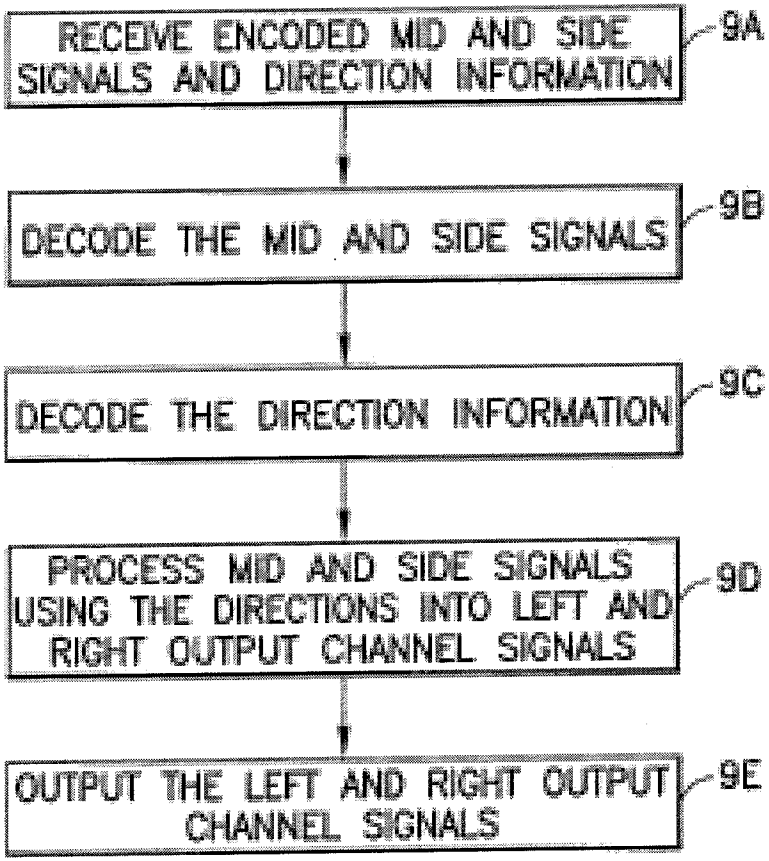
FIG. 9 is a block diagram of operations performed by the decoder from FIG. 7.
Figure 8:
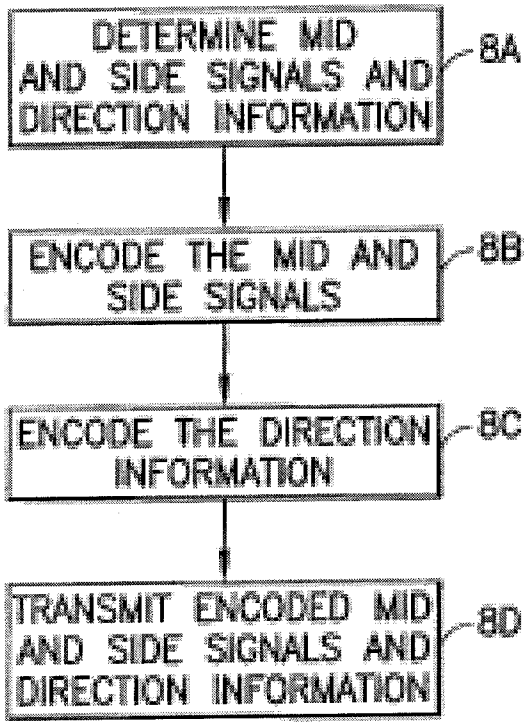
FIG. 8 is a block diagram of operations performed by the encoder from FIG. 7.

FIG. 7 illustrates a block diagram of a second system 700 suitable for performing embodiments of the invention for signal coding aspects of the invention. FIG. 8 is a block diagram of operations performed by the encoder from FIG. 7, and FIG. 9 is a block diagram of operations performed by the decoder from FIG. 7. There are two electronic devices 710, 705 that communicate using their network interfaces 630-1, 630-2, respectively, via a wired or wireless network 725. The encoder 715 performs operations on the frequency-domain microphone signals 621 to create at least the mid signal 717 (see equation (13)). Additionally, the encoder 715 may also create the side signal 718 (see equation (14) above), along with the directions 719 (see equation (12) above) via, e.g., the equations (1) -(14) described above (block 8A of FIG. 8). The options include (1) only the mid signal, (2) the mid signal and directional information, or (3) the mid signal and directional information and the side signal. Conceivably, there could also be (4) mid signal and side signal and (5) side signal alone, although these might be less useful than the options (1) to (3).

The encoder 715 also encodes these as encoded mid signal 721, encoded side signal 722, and encoded directional information 723 for coupling via the network 725 to the electronic device 705. The mid signal 717 and side signal 718 can be coded independently using commonly used audio codecs (coder/decoders) to create the encoded mid signal 721 and the encoded side signal 722, respectively. Suitable commonly used audio codecs are for example AMR-WB+, MP3, AAC and AAC+. This occurs in block 8B. For coding the directions 719 (i.e., $\alpha_b$ from equation (12)) (block 8C), as an example, assume a typical codec structure with 20 ms (millisecond) frames (50 frames per second) and 20 subbands per frame (B=20). Every $\alpha_b$ can be quantized for example with five bits, providing resolution of 11.25 degrees for the arriving sound direction, which is enough for most applications. In this case, the overall bit rate for the coded directions would be 50*20*5=5.00 kbps (kilobits per second) as encoded directional information 723. Using more advanced coding techniques (lower resolution is needed for directional information at higher frequencies; there is typically correlation between estimated sound directions in different subbands which can be utilized in coding, etc.), this rate could probably be dropped, for example, to 3 kbps. The network interface 630-1 then transmits the encoded mid signal 721, the encoded side signal 722, and the encoded directional information 723 in block 8D.

The decoder 730 in the electronic device 705 receives (block 9A) the encoded mid signal 721, the encoded side signal 722, and the encoded directional information 723, e.g., via the network interface 630-2. The decoder 730 then decodes (block 9B) the encoded mid signal 721 and the encoded side signal 722 to create the decoded mid signal 741 and the decoded side signal 742. In block 9C, the decoder uses the encoded directional information 719 to create the decoded directions 743. The decoder 730 then performs equations (15) to (21) above (block 9D) using the decoded mid signal 741, the decoded side signal 742, and the decoded directions 743 to determine the output channel signals 660-1 through 660-N. These output channels 660 are then output in block 9E, e.g., to an internal or external N-channel DAC.

In the exemplary embodiment of FIG. 7, the encoder 715/decoder 730 contains computer program code that, when executed by the processors 615, causes the electronic device 710/705 to carry out one or more of the operations described herein. In another exemplary embodiment, the encoder/decoder or a portion thereof is implemented in hardware (e.g., a semiconductor circuit) that is defined to perform one or more of the operations described above.

Alternative Implementations

Above, an exemplary implementation was described. However, there are numerous alternative implementations which can be used as well. Just to mention few of them:

1) Numerous different microphone setups can be used. The algorithms have to be adjusted accordingly. The basic algorithm has been designed for three microphones, but more microphones can be used, for example to make sure that the estimated sound source directions are correct.

2) The algorithm is not especially complex, but if desired it is possible to submit three (or more) signals first to a separate computation unit which then performs the actual processing.

3) It is possible to make the recordings and the actual processing in different locations. For instance, three independent devices, each with one microphone can be used, which then transmit the signal to a separate processing unit (e.g., server) which then performs the actual conversion to binaural signal.

4) It is possible to create binaural signal using only directional information, i.e. side signal is not used at all. Considering solutions in which the binaural signal is coded, this provides lower total bit rate as only one channel needs to be coded.

5) HRTFs can be normalized beforehand such that normalization (equation (19)) does not have to be repeated after every HRTF filtering.

6) The left and right signals can be created already in frequency domain before inverse DFT. In this case the possible decorrelation filtering is performed directly for left and right signals, and not for the side signal.

Furthermore, in addition to the embodiments mentioned above, the embodiments of the invention may be used also for:

1) Gaming applications;

2) Augmented reality solutions;

3) Sound scene modification: amplification or removal of sound sources from certain directions, background noise removal/amplification, and the like.

However, these may require further modification of the algorithm such that the original spatial sound is modified. Adding those features to the above proposal is however relatively straightforward.

Techniques for Converting Multi-Microphone Capture to Multi-Channel Signals

Reference was made above, e.g., in regards to FIG. 6, with providing multiple digital output signals 660. This section describes additional exemplary embodiments for providing such signals.

An exemplary problem is to convert the capture of multiple omnidirectional microphones in known locations into good quality multichannel sound. In the below material, a 5.1 channel system is considered, but the techniques can be straightforwardly extended to other multichannel loudspeaker systems as well. In the capture end, a system is referred to with three microphones on horizontal level in the shape of a triangle, as illustrated in FIG. 1. However, also in the recording end the used techniques can be easily generalized to different microphone setups. An exemplary requirement is that all the microphones are able to capture sound events from all directions.

The problem of converting multi-microphone capture into a multichannel output signal is to some extent consistent with the problem of converting multi-microphone capture into a binaural (e.g., headphone) signal. It was found that a similar analysis can be used for multichannel synthesis as described above. This brings significant advantages to the implementation, as the system can be configured to support several output signal types. In addition, the signal can be compressed efficiently.

A problem then is how to turn spatially analyzed input signals into multichannel loudspeaker output with good quality, while maintaining the benefit of efficient compression and support for different output types. The materials describe below present exemplary embodiments to solve this and other problems.

Overview

In the below-described exemplary embodiments, the directional analysis is mainly based on the above techniques. However, there are a few modifications, which are discussed below.

It will be now detailed how the developed mid/side representations can be utilized together with the directional information for synthesizing multi-channel output signals. As an exemplary overview, a mid signal is used for generating directional multi-channel information and the side signal is used as a starting point for ambience signal. It should be noted that the multi-channel synthesis described below is quite a bit different from the binaural synthesis described above and utilizes different technologies.

The estimation of directional information may especially in noisy situations not be particularly accurate, which is not a perceptually desirable situation for multi-channel output formats. Therefore, as an exemplary embodiment of the instant invention, subbands with dominant sound source directions are emphasized and potentially single subbands with deviating directional estimates are attenuated. That is, in case the direction of sound cannot be reliably estimated, then the sound is divided more evenly to all reproduction channels, i.e., it is assumed that in this case all the sound is rather ambient-like. The modified directional information is used together with the mid signal to generate directional components of the multi-channel signals. A directional component is a part of the signal that a human listener perceives coming from a certain direction. A directional component is opposite from an ambient component, which is perceived to come from all directions. The side signal is also, in an exemplary embodiment, extended to the multi-channel format and the channels are decorrelated to enhance a feeling of ambience. Finally, the directional and ambience components are combined and the synthesized multi-channel output is obtained.

One should also notice that the exemplary proposed solutions enable efficient, good-quality compression of multi-channel signals, because the compression can be performed before synthesis. That is, the information to be compressed includes mid and side signals and directional information, which is clearly less than what the compression of 5.1 channels would need.

Directional Analysis

The directional analysis method proposed for the examples below follows the techniques used above. However, there are a few small differences, which are introduced in this section.

Directional analysis (block 10A of FIG. 10) is performed in the DFT (i.e., frequency) domain. One difference from the techniques used above is that while adding zeroes to the end of the time domain window before the DFT transform, the delay caused by HRTF filtering does not have to be considered in the case of multi-channel output.

As described above, it was assumed that a dominant sound source direction for every subband was found. However, in the multi-channel situation, it has been noticed that in some cases, it is better not to define the direction of a dominant sound source, especially if correlation values between microphone channels are low. The following correlation computation $$\max_{\tau_b} Re(\Sigma_{n=0}^{nb+1\to nb-1}(X_{2,\tau_b}{}^{b}(n)^{*}X_3{}^{b}(n))),\tau_b-\epsilon[-D_{max},D_{max}], \quad (21)$$

provides information on the degree of similarity between channels. If the correlation appears to be low, a special procedure (block 10E of FIG. 10) can be applied. This procedure operates as follows:

```
If max_{τ_b} Re(Σ_{n=0}^{n_{b+1}-n_b-1}(X_{2,τ_b}^b(n)*X_3^b(n))) < cor_lim_b:
    α_b = Ø;
    τ_b = 0;
Else
    Obtain α_b as previously indicated above (e.g., equation 12).
```

In the above, $cor_lim_b$ is the lowest value for an accepted correlation for subband b, and Ø indicates a special situation that there is not any particular direction for the subband. If there is not any particularly dominant direction, also the delay $\tau_b$ is set to zero. Typically, $cor_lim_b$ values are selected such that stronger correlation is required for lower frequencies than for higher frequencies. It is noted that the correlation calculation in equation 21 affects how the mid channel energy is distributed. If the correlation is above the threshold, then the mid channel energy is distributed mostly to one or two channels, whereas if the correlation is below the threshold then the mid channel energy is distributed rather evenly to all the channels. In this way, the dominant sound source is emphasized relative to other directions if the correlation is high.

Above, the directional estimation for subband b was described. This estimation is repeated for every subband. It is noted that the implementation (e.g., via block 10E of FIG. 1) of equation (21) emphasizes the dominant source directions relative to other directions once the mid signal is determined (as described below; see equation 22).

Multi-Channel Synthesis

This section describes how multi-channel signals are generated from the input microphone signals utilizing the directional information. The description will mainly concentrate on generating 5.1 channel output. However, it is straightforward to extend the method to other multi-channel formats (e.g., 5-channel, 7-channel, 9-channel, with or without the LFE signal) as well. It should be noted that this synthesis is different from binaural signal synthesis described above, as the sound sources should be panned to directions of the speakers. That is, the amplitudes of the sound sources should be set to the correct level while still maintaining the spatial ambience sound generated by the mid/side representations.

After the directional analysis as described above, estimates for the dominant sound source for every subband b have been determined. However, the dominant sound source is typically not the only source. Additionally, the ambience should be considered. For that purpose, the signal is divided into two parts: the mid and side signals. The main content in the mid signal is the dominant sound source, which was found in the directional analysis. The side signal mainly contains the other parts of the signal. In an exemplary proposed approach, mid (M) signals and side (S) signals are obtained for subband b as follows (block 10B of FIG. 10):

$$M^b = \begin{cases} (X_{2,\tau_b}^b + X_3^b)/2 & \tau_b \le 0 \\ (X_2^b + X_{3,-\tau_b}^b)/2 & \tau_b > 0 \end{cases} \quad (22)$$

$$S^b = \begin{cases} (X_{2,\tau_b}^b - X_3^b)/2 & \tau_b \le 0 \\ (X_2^b - X_{3,-\tau_b}^b)/2 & \tau_b > 0 \end{cases} \quad (23)$$

For equation 22, see also equations 5 and 13 above; for equation 23, see also equation 14 above. It is noted that the $\tau_b$ in equations (22) and (23) have been modified by the directional analysis described above, and this modification emphasizes the dominant source directions relative to other directions once the mid signal is determined per equation 22. The mid and side signals are constructed in a perceptually safe manner such that the signal in which an event occurs first is not shifted in the delay alignment. This approach is suitable as long as the microphones are relatively close to each other. If the distance is significant in relation to the distance to the sound source, a different solution is needed. For example, it can be selected that channel 2 (two) is always modified to provide the best match with channel 3 (three).

A 5.1 multi-channel system consists of 6 channels: center (C), front-left (F_L), front-right (F_R), rear-left (R_L), rear-right (R_R), and low frequency channel (LFE). In an exemplary embodiment, the center channel speaker is placed at zero degrees, the left and right channels are placed at ±30 degrees, and the rear channels are placed at ±110 degrees. These are merely exemplary and other placements may be used. The LFE channel contains only low frequencies and does not have any particular direction. There are different methods for panning a sound source to a desired direction in 5.1 multi-channel system. A reference having one possible panning technique is Craven P. G., "Continuous surround panning for 5-speaker reproduction," in AES 24th International Conference on Multi-channel Audio, June 2003. In this reference, for a subband b, a sound source $Y^b$ in direction θ introduces content to channels as follows:

$$C^b = g_C^b(\theta) Y^b$$

$$F_L^b = g_{FL}^b(\theta) Y^b$$

$$F_R^b = g_{FR}^b(\theta) Y^b$$

$$R_L^b = g_{RL}^b(\theta) Y^b$$

$$R_R^b = g_{RR}^b(\theta) Y^b \quad (24)$$

where $Y^b$ corresponds to the bth subband of signal Y and $g_X^b(\theta)$ (where X is one of the output channels) is a gain factor for the same signal. The signal Y here is an ideal non-existing sound source that is desired to appear coming from direction θ. The gain factors are obtained as a function of θ as follows (equation 25):

$$g_C^b(\theta) = 0.10492 + 0.33223\cos(\theta) + 0.26500\cos(2\theta) + 0.16902\cos(3\theta) + 0.05978\cos(4\theta);$$

$$g_{FL}^b(\theta) = 0.16656 + 0.24162\cos(\theta) + 0.27215\sin(\theta) - 0.05322\cos(2\theta) + 0.22189\sin(2\theta) - 0.08418\cos(3\theta) + 0.05939\sin(3\theta) - 0.06994\cos(4\theta) + 0.08435\sin(4\theta);$$

$$g_{FR}^b(\theta) = 0.16656 + 0.24162\cos(\theta) - 0.27215\sin(\theta) - 0.05322\cos(2\theta) - 0.22189\sin(2\theta) - 0.08418\cos(3\theta) - 0.05939\sin(3\theta) - 0.06994\cos(4\theta) - 0.08435\sin(4\theta);$$

$$g_{RL}^b(\theta) = 0.35579 - 0.35965\cos(\theta) + 0.42548\sin(\theta) - 0.06361\cos(2\theta) - 0.11778\sin(2\theta) + 0.00012\cos(3\theta) - 0.04692\sin(3\theta) + 0.02722\cos(4\theta) - 0.06146\sin(4\theta);$$

$$g_{RR}^b(\theta) = 0.35579 - 0.35965\cos(\theta) - 0.42548\sin(\theta) - 0.06361\cos(2\theta) + 0.11778\sin(2\theta) + 0.00012\cos(3\theta) + 0.04692\sin(3\theta) + 0.02722\cos(4\theta) + 0.06146\sin(4\theta).$$

A special case of above situation occurs when there is no particular direction, i.e., θ=Ø. In that case fixed values can be used as follows:

$$g_C^b(\emptyset)=\delta_C$$

$$g_{FL}^b(\emptyset)=\delta_{FL}$$

$$g_{FR}^b(\emptyset)=\delta_{FR}$$

$$g_{RL}^b(\emptyset)=\delta_{RL}$$

$$g_{RR}^b(\emptyset)=\delta_{RR} \tag{26}$$

where parameters $\delta_X$ are fixed values selected such that the sound caused by the mid signal is equally loud in all directional components of the mid signal.

Mid Signal Processing

With the above-described method, a sound can be panned around to a desired direction. In an exemplary embodiment of the instant invention, this panning is applied only for mid signal $M^b$. By substituting the directional information $\alpha^b$ to equation (25), the gain factors $g_X^b(\alpha^b)$ are obtained (block 10C of FIG. 10) for every channel and subband. It is noted that the techniques herein are described as being applicable to 5 or more channels (e.g. 5.1, 7.1, 11.1), but the techniques are also suitable for two or more channels (e.g., from stereo to other multi-channel outputs).

Using equation (24), the directional component of the multi-channel signals may be generated. However, before panning, in an exemplary embodiment, the gain factors $g_X^b(\alpha^b)$ are modified slightly. This is because due to, for example, background noise and other disruptions, the estimation of the arriving sound direction does not always work perfectly. For example, if for one individual subband the direction of the arriving sound is estimated completely incorrectly, the synthesis would generate a disturbing unconnected short sound event to a direction where there are no other sound sources. This kind of error can be disturbing in a multi-channel output format. To avoid this, in an exemplary embodiment (see block 10F of FIG. 10), preprocessing is applied for gain values $g_X^b$. More specifically, a smoothing filter h(k) with length of 2K+1 samples is applied as follows:

$$\hat{g}_X^b=\Sigma_{k=0}^{2K}(h(k)g_X^{b-K+k}),K\leq b\leq B-(K+1). \tag{27}$$

For clarity, directional indices $\alpha^b$ have been omitted from the equation. It is noted that application of equation 27 (e.g., via block 10F of FIG. 10) has the effect of attenuating deviating directional estimates. Filter h(k) is selected such that $\Sigma_{k=0}^{2K}h(k)=1$. For example when K=2, h(k) can be selected as $$h(k)=\{1/12,1/4,1/3,1/4,1/12\},k=0,\ldots,4. \tag{28}$$

For the K first and last subbands, a slightly modified smoothing is used as follows:

$$\hat{g}_X^b=\frac{\sum_{k=K-b}^{2K}(h(k)g_X^{b-K+k})}{\sum_{k=K-b}^{2K}h(k)},\ 0\leq b\leq K, \tag{29}$$

$$\hat{g}_X^b=\frac{\sum_{k=0}^{K+B-1-b}(h(k)g_X^{b-K+k})}{\sum_{k=0}^{K+B-1-b}h(k)},\ B-K\leq b\leq B-1. \tag{30}$$

With equations (27), (29) and (30), smoothed gain values $\hat{g}_X^b$ are achieved. It is noted that the filter has the effect of attenuating sudden changes and therefore the filter attenuates deviating directional estimates (and thereby emphasizes the dominant sound source relative to other directions). The values from the filter are now applied to equation (24) to obtain (block 10D of FIG. 10) directional components from the mid signal:

$$C_M^b=\hat{g}_C^bM^b$$

$$F_L_M^b=\hat{g}_{FL}^bM^b$$

$$F_R_M^b=\hat{g}_{FR}^bM^b$$

$$R_L_M^b=\hat{g}_{RL}^bM^b$$

$$R_R_M^b=\hat{g}_{RR}^bM^b. \tag{31}$$

It is noted in equation (31) that $M^b$ substitutes for Y. The signal Y is not a microphone signal but rather an ideal non-existing sound source that is desired to appear coming from direction θ. In the technique of equation 31, an optimistic assumption is made that one can use the mid ($M^b$) signal in place of the ideal non-existing sound source signals (Y). This assumption works rather well.

Finally, all the channels are transformed into the time domain (block 10G of FIG. 10) using an inverse DFT, sinusoidal windowing is applied, and the overlapping parts of the adjacent frames are combined. After all of these stages, the result in this example is five time-domain signals.

Notice above that only one smoothing filter structure was presented. However, many different smoothing filters can be used. The main idea is to remove individual sound events in directions where there are no other sound occurrences.

Side Signal Processing

The side signal $S^b$ is transformed (block 100) to the time domain using inverse DFT and, together with sinusoidal windowing, the overlapping parts of the adjacent frames are combined. The time-domain version of the side signal is used for creating an ambience component to the output. The ambience component does not have any directional information, but this component is used for providing a more natural spatial experience.

Figure 10:
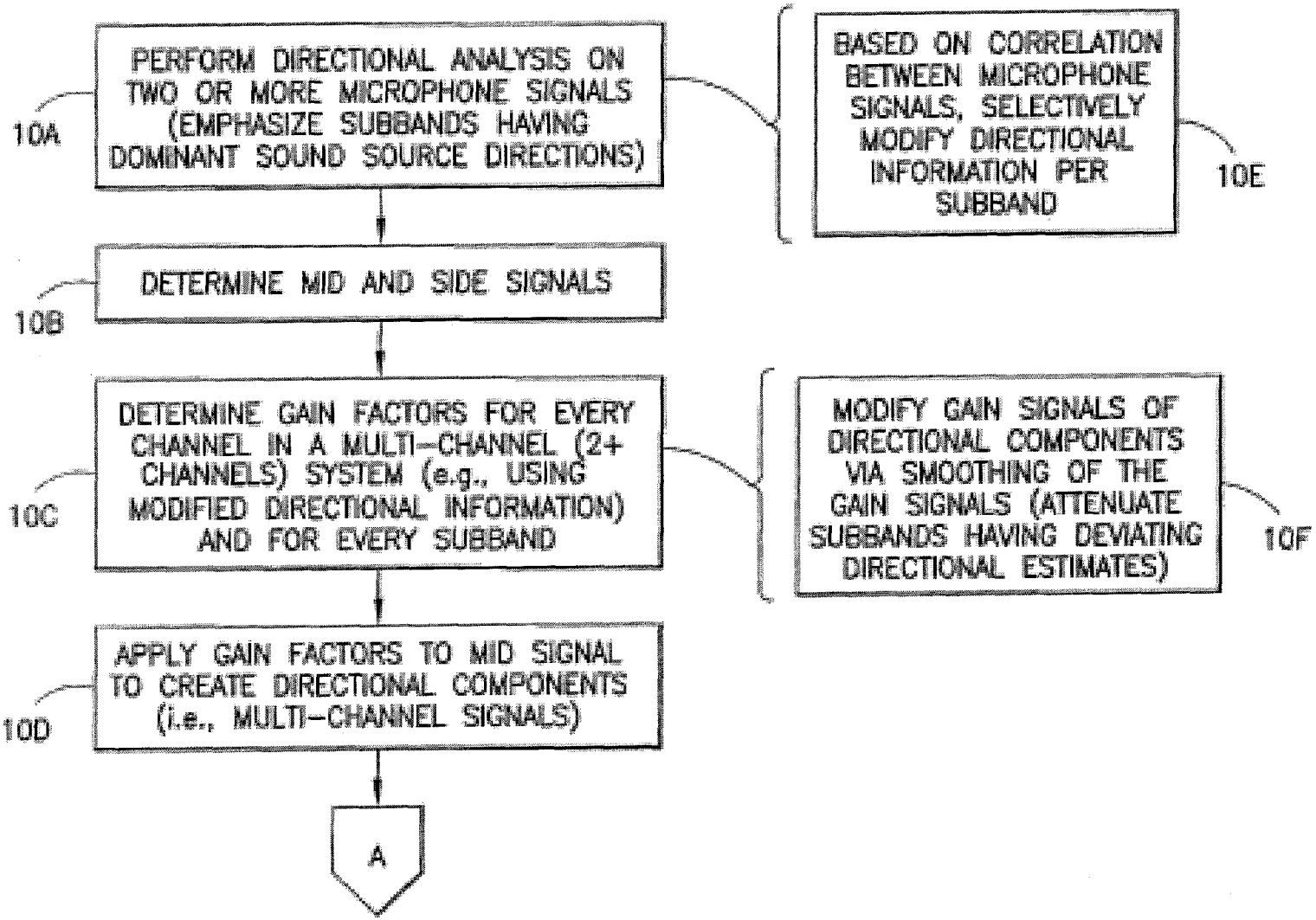
FIG. 10 is a block diagram of a flowchart for synthesizing multi-channel output signals from recorded microphone signals.
Figure 10:
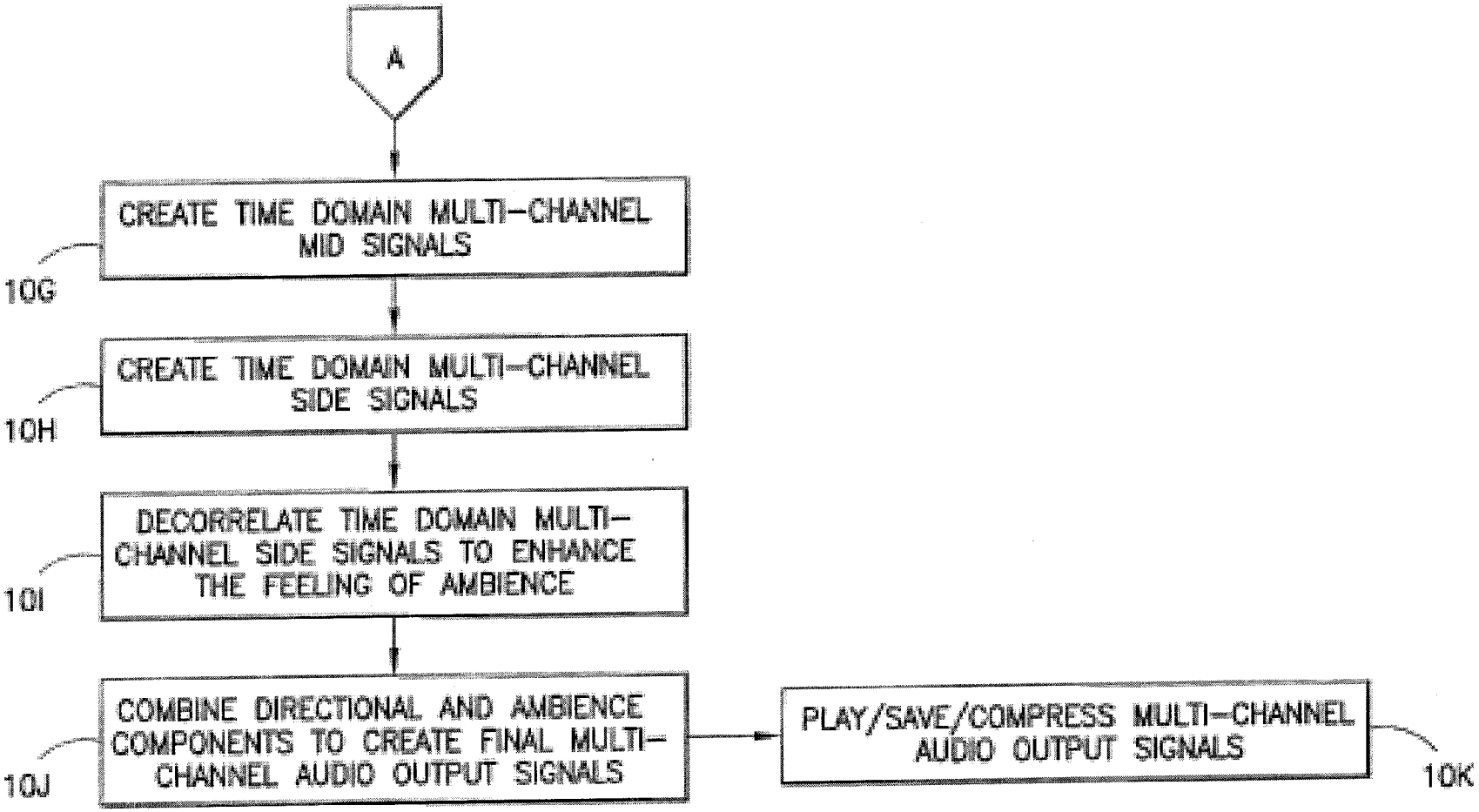

The externalization of the ambience component can be enhanced by the means, an exemplary embodiment, of decorrelation (block 10I of FIG. 10). In this example, individual ambience signals are generated for every output channel by applying different decorrelation process to every channel. Many kinds of decorrelation methods can be used, but an all-pass type of decorrelation filter is considered below. The considered filter is of the form $$D_X(z)=\frac{\beta_X+z^{-P_X}}{1+\beta_Xz^{-P_X}}, \tag{32}$$

where X is one of the output channels as before, i.e., every channel has a different decorrelation with its own parameters $\beta_X$ and $P_X$. Now all the ambience signals are obtained from time domain side signal S(z) as follows:

$$C_S(z)=D_C(z)S(z)$$

$$F_L_S(z)=D_{F_L}(z)S(z)$$

$$F_R_S(z)=D_{F_R}(z)S(z)$$

$$R_L_S(z)=D_{R_L}(z)S(z)$$

$$R_R_S(z)=D_{R_R}(z)S(z) \tag{33}$$

The parameters of the decorrelation filters, $\beta_X$ and $P_X$, are selected in a suitable manner such that any filter is not too similar with another filter, i.e., the cross-correlation between decorrelated channels must be reasonably low. On the other hand, the average group delay of the filters should be reasonably close to each other.

Combining Directional and Ambience Components

We now have time domain directional and ambience signals for all five output channels. These signals are combined (block 10J) as follows:

$$C(z)=z^{-P_D}C_M(z)+\gamma C_s(z)$$

$$F_L(z)=z^{-P_D}F_L_M(z)+\gamma F_L_S(z)$$

$$F_R(z)=z^{-P_D}F_R_M(z)+\gamma F_R_S(z)$$

$$R_L(z)=z^{-P_D}R_L_M(z)+\gamma R_L_S(z)$$

$$R_R(z)=z^{-P_D}R_R_M(z)+\gamma R_R_S(z) \quad (34)$$

where $P_D$ is a delay used to match the directional signal with the delay caused to the side signal due to the decorrelation filtering operation, and $\gamma$ is a scaling factor that can be used to adjust the proportion of the ambience component in the output signal. Delay $P_D$ is typically set to the average group delay of the decorrelation filters.

With all the operations presented above, a method was introduced that converts the input of two or more (typically three) microphones into five channels. If there is a need to create content also to the LFE channel, such content can be generated by low pass filtering one of the input channels.

The output channels can now (block 10K) be played with a multi-channel player, saved (e.g., to a memory or a file), compressed with a multi-channel coder, etc.

Signal Compression

Multi-channel synthesis provides several output channels, in the case of 5.1 channels there are six output channels. Coding all these channels requires a significant bit rate. However, before multi-channel synthesis, the representation is much more compact: there are two signals, mid and side, and directional information. Thus if there is a need for compression for example for transmission or storage purposes, it makes sense to use the representation which precedes multi-channel synthesis. An exemplary coding and synthesis process is illustrated in FIG. 11.

Figure 11:
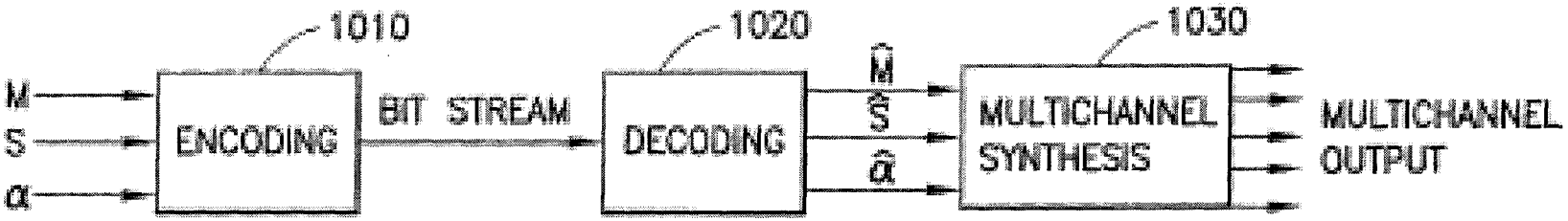
FIG. 11 is a block diagram of an exemplary coding and synthesis process.

In FIG. 11, M and S are time domain versions of the mid and side signals, and $\propto$ represents directional information, e.g., there are B directional parameters in every processing frame. In an exemplary embodiment, the M and S signals are available only after removing the delay differences. To make sure that delay differences between channels are removed correctly, the exact delay values are used in an exemplary embodiment when generating the M and S signals. In the synthesis side, the delay value is not equally critical (as the delay value signal is used for analyzing sound source directions) and small modification in the delay value can be accepted. Thus, even though delay value might be modified, M and S signals should not be modified in subsequent processing steps. However, it should be noted that mid and side signals are usually encoded with an audio encoder (e.g., MP3, motion picture experts group audio layer 3, AAC, advanced audio coding) between the sender and receiver when the files are either stored to a medium or transmitted over a network. The audio encoding-decoding process usually modifies the signals a little (i.e., is lossy), unless lossless codecs are used.

Encoding 1010 can be performed for example such that mid and side signals are both coded using a good quality mono encoder. The directional parameters can be directly quantized with suitable resolution. The encoding 1010 creates a bit stream containing the encoded M, S, and $\propto$. In decoding 1020, all the signals are decoded from the bit stream, resulting in output signals $\hat{M}$, $\hat{S}$ and $\hat{\propto}$. For multi-channel synthesis 1030, mid and side signals are transformed back into frequency domain representations.

Example Use Case

As an example use case, a player is introduced with multiple output types. Assume that a user has captured video with his mobile device together with audio, which has been captured with, e.g., three microphones. Video is compressed using conventional video coding techniques. The audio is processed to mid/side representations, and these two signals together with directional information are compressed as described in signal compression section above.

The user can now enjoy the spatial sound in two different exemplary situations:

1) Mobile use—The user watches the video he/she recorded and listens to corresponding audio using headphones. The player recognizes that headphones are used and automatically generates a binaural output signal, e.g., in accordance with the techniques presented above.

2) Home theatre use—The user connects his/her mobile device to a home theatre using, for example, an HDMI (high definition multimedia interface) connection or a wireless connection. Again, the player recognizes that now there are more output channels available, and automatically generates 5.1 channel output (or other number of channels depending on the loudspeaker setup).

Regarding copying to other devices, the user may also want to provide a copy of the recording to his friends who do not have a similar advanced player as in his device. In this case, when initiating the copying process, the device may ask which kind of audio track user wants to attach to the video and attach only one of the two-channel or the multi-channel audio output signals to the video. Alternatively, some file formats allow multiple audio tracks, in which case all alternative (i.e., two-channel or multi-channel, where multi-channel is greater than two channels) audio track types can be included in a single file. As a further example, the device could store two separate files, such that one file contains the two-channel output signals and another file contains the multi-channel output signals.

Example System and Method

Figure 12:
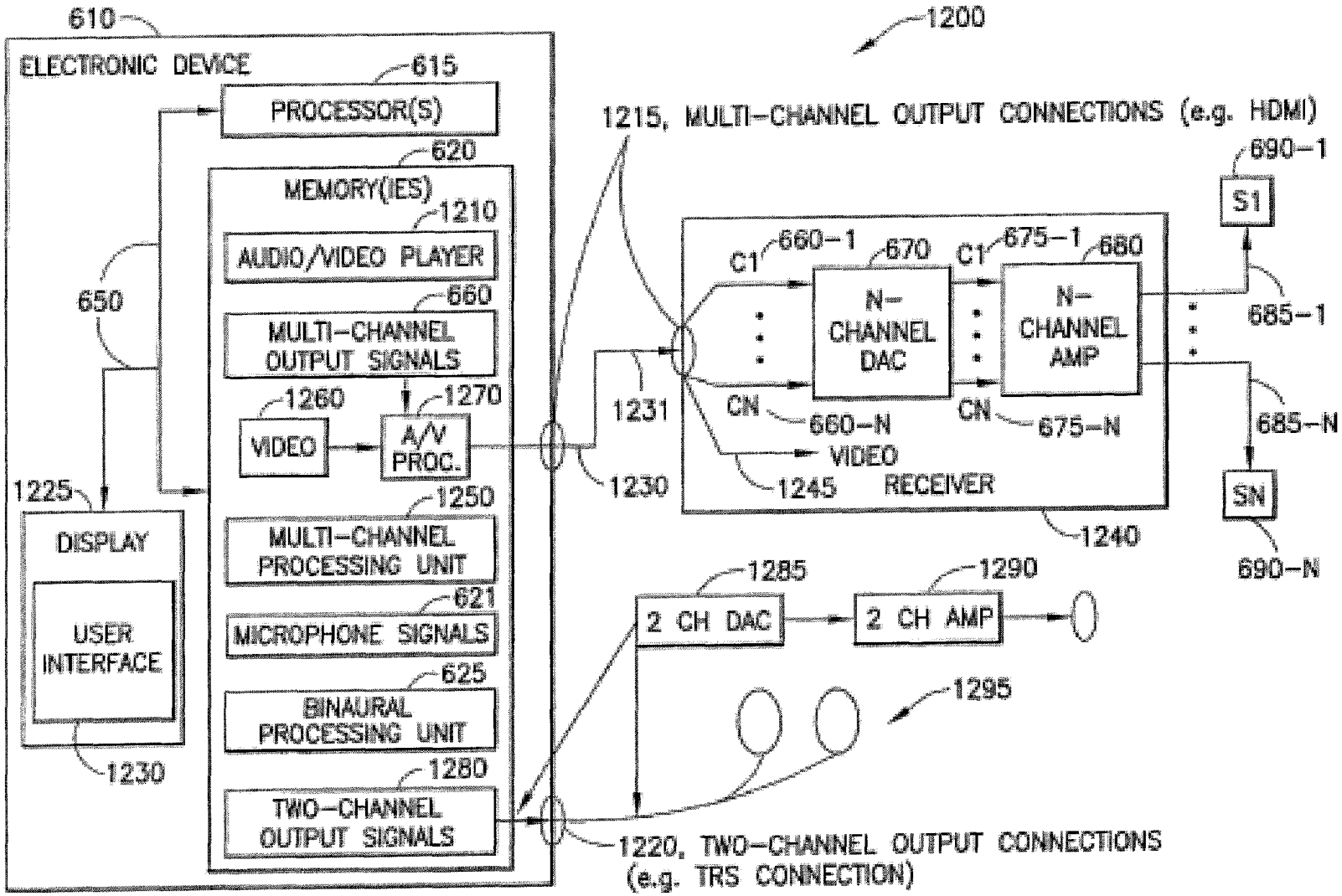
FIG. 12 is a block diagram of a system for synthesizing binaural signals and corresponding two-channel audio output signals and/or synthesizing multi-channel audio output signals from multiple recorded microphone signals.

An example system is shown in FIG. 12. This system 1200 uses some of the components from the system of FIG. 6, and those components will not be described again in this section. The system 1200 includes an electronic device 610. In this example, the electronic device 610 includes a display 1225 that has a user interface 1230. The one or more memories 620 in this example further include an audio/video player 1201, a video 1260, an audio/video processing (proc.) unit (1270), a multi-channel processing unit 1250, and two-channel output signals 1280. The two-channel (2 Ch) DAC 1285 and the two-channel amplifier (amp) 1290 could be internal to the electronic device 610 or external to the electronic device 610. Therefore, the two-channel output connection 1220 could be, e.g., an analog two-channel connection such as a TRS (tip, ring, sleeve) (female) connection (shown connected to earbuds 1295) or a digital connection (e.g., USB or two-channel digital connector such as an optical connector). In this example, the N-channel DAC 670 and N-channel amp 680 are housed in a receiver 1240. The receiver 1240 typically separates the signals received via the multi-channel output connections 1215 into their component parts, such as the CN channels 660 of digital audio in this example and the video 1245. Typically, this separation is performed by a processor (not shown in this figure) in the receiver 1240.

There are also multi-channel output connection 1215, such as HDMI (high definition multimedia interface), connected using a cable 1230 (e.g., HDMI cable). Another example of connection 1215 would be an optical connection (e.g., S/PDIF, Sony/Philips Digital Interconnect Format) using an optical fiber 1230, although typical optical connections only handle audio and not video.

The audio/video player 1210 is an application (e.g., computer-readable code) that is executed by the one or more processors 615. The audio/video player 1210 allows audio or video or both to be played by the electronic device 610. The audio/video player 1210 also allows the user to select whether one or both of two-channel output audio signals or multi-channel output audio signals should be put in an A/V file (or bitstream) 1231.

The multi-channel processing unit 1250 processes recorded audio in microphone signals 621 to create the multi-channel output audio signals 660. That is, in this example, the multi-channel processing unit 1250 performs the actions in, e.g., FIG. 10. The binaural processing unit 625 processes recorded audio in microphone signals 621 to create the two-channel output audio signals 1280. For instance, the binaural processing unit 625 could perform, e.g., the actions in FIGS. 2-5 above. It is noted in this example that the division into the two units 1250, 625 is merely exemplary, and these may be further subdivided or incorporated into the audio/video player 1210. The units 1250, 625 are computer-readable code that is executed by the one or more processor 615 and these are under control in this example of the audio video player.

It is noted that the microphone signals 621 may be recorded by microphones in the electronic device 610, recorded by microphones external to the electronic device 621, or received from another electronic device 610, such as via a wired or wireless network interface 630.

Figure 14:
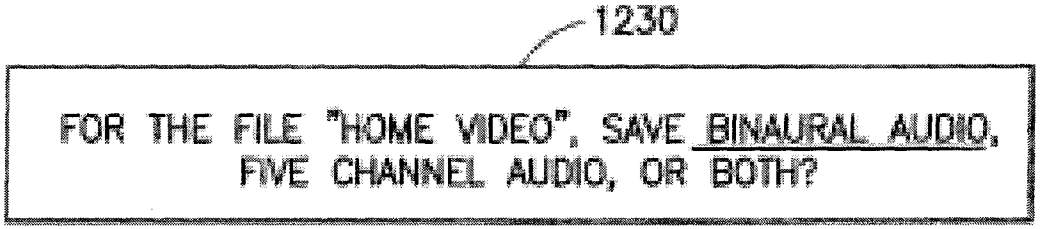
FIG. 14 is an example of a user interface to allow a user to select whether one or both of two-channel or multi-channel audio should be output.
Figure 13:
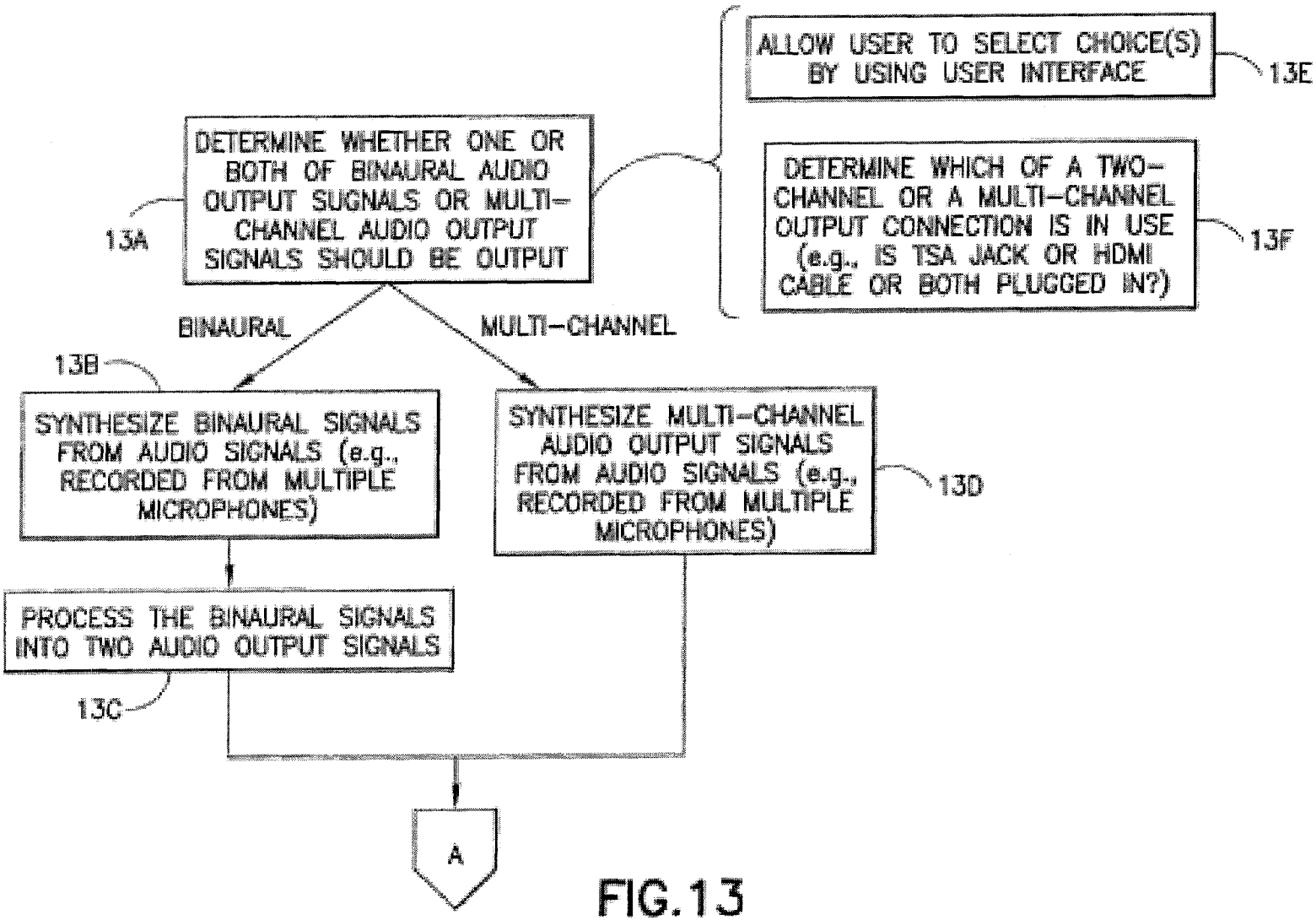
FIG. 13 is a block diagram of a flowchart for synthesizing binaural signals and corresponding two-channel audio output signals and/or synthesizing multi-channel audio output signals from multiple recorded microphone signals.
Figure 13:
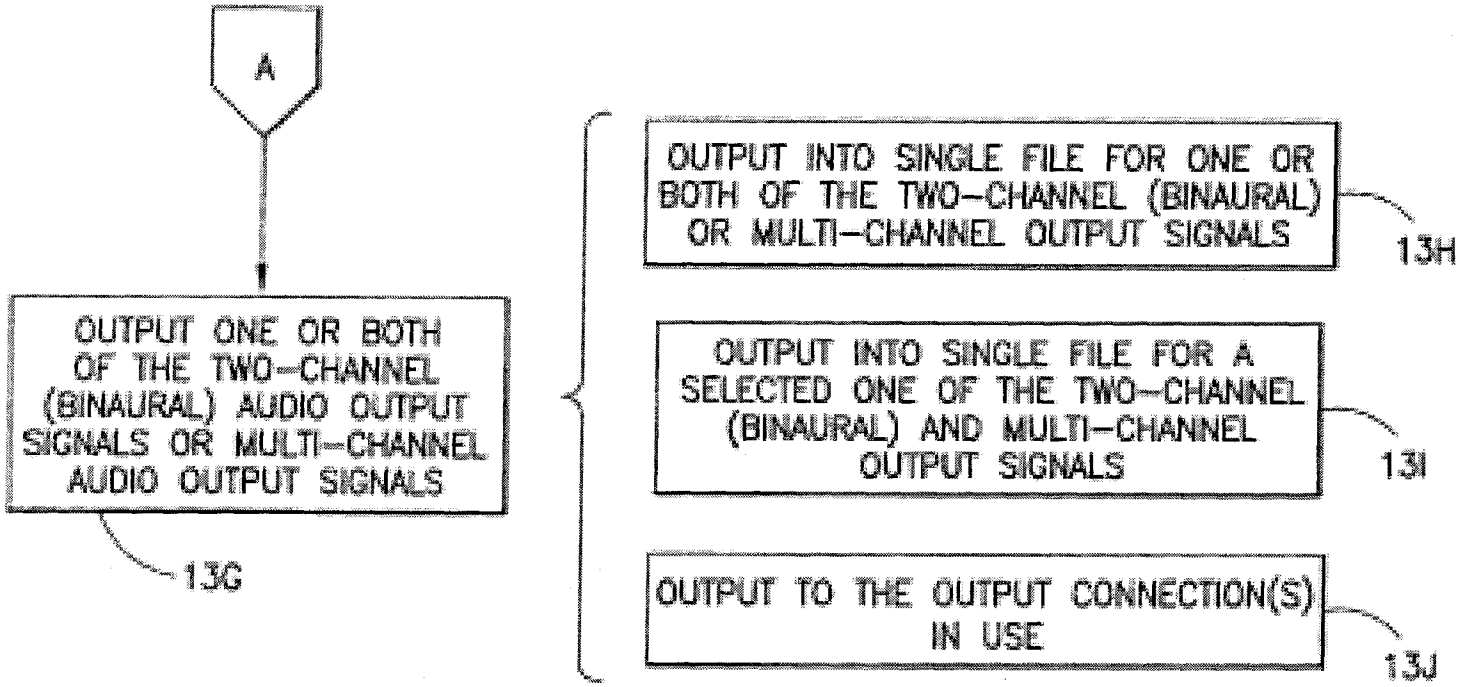

Additional detail about the system 1200 is described in relation to FIGS. 13 and 14. FIG. 13 is a block diagram of a flowchart for synthesizing binaural signals and corresponding two-channel audio output signals and/or synthesizing multi-channel audio output signals from multiple recorded microphone signals. FIG. 13 describes, e.g., the exemplary use cases provided above.

In block 13A, the electronic device 610 determines whether one or both of binaural audio output signals or multi-channel audio output signals should be output. For instance, a user could be allowed to select choice(s) by using user interface 1230 (block 13E). In more detail, the audio/video player could present the text shown in FIG. 14 to a user via the user interface 1230, such as a touch screen. In this example, the user can select "binaural audio" (currently underlined), "five channel audio", or "both" using his or her finger, such as by sliding a finger between the different options (whereupon each option would be highlighted by underlining the option) and then a selection is made when the user removes the finger. The "two channel audio" in this example would be binaural audio. FIG. 14 shows one non-limiting option and many others may be performed.

As another example of block 13A, in block 13F of FIG. 13, the electronic device 610 (e.g., under control of the audio/video player 1210) determines which of a two-channel or a multi-channel output connection is in use (e.g., which of the TSA jack or the HDMI cable, respectively, or both is plugged in). This action may be performed through known techniques.

If the determination is that binaural audio output is selected, blocks 13B and 13C are performed. In block 13B, binaural signals are synthesized from audio signals 621 recorded from multiple microphones. In block 13C, the electronic device 610 processes the binaural signals into two audio output signals 1280 (e.g., containing binaural audio output). For instance, blocks 13A and 13B could be performed by the binaural processing unit 625 (e.g., under control of the audio/video player 1210).

If the determination is that multi-channel audio output is selected, block 13D is performed. In block 13D, the electronic device 610 synthesizes multi-channel audio output signals 660 from audio signals 621 recorded from multiple microphones. For instance, block 13D could be performed by the multi-channel processing unit 1250 (e.g., under control of the audio/video player 1210). It is noted that it would be unlikely that both the TSA jack and the HDMI cable would be plugged in at one time, and thus the likely scenario is that only 13B/13C or only 13D would be performed at one time (and in 13G, only the corresponding one of the audio output signals would be output). However, it is possible for 13B/13C and 13D to both be performed (e.g., both the TSA jack and the HDMI cable would be plugged in at one time) and in block 13G, both the resultant audio output signals would be output.

In block 13G, the electronic device 610 (e.g., under control of the audio/video player 1210) outputs one or both of the two-channel audio output signals 1280 or multi-channel audio output signals 660. It is noted that the electronic device 610 may output an A/V file (or stream) 1231 containing the multi-channel output signals 660. Block 13G may be performed in numerous ways, of which three exemplary ways are outlined in blocks 13H, 13I, and 13J.

In block 13H, one or both of the two- or multi-channel output signals 1280, 660 are output into a single (audio or audio and video) file 1231. In block 13I, a selected one of the two- and multi-channel output signals are output into single (audio or audio and video) file 1231. That is, the two-channel output signals 1280 are output into a single file 1231, or the multi-channel output signals 660 are output into a single file 1231. In block 13J, one or both of the two- or multi-channel output signals 1280, 660 are output to the output connection(s) 1220, 1215 in use.

Alternative Implementations

Above the most preferred implementation for generating 5.1 signals from a three-microphone input was presented. However, there are several possibilities for alternative implementations. A few exemplary possibilities are as follows.

The algorithms presented above are not especially complex, but if desired it is possible to submit three (or more) signals first to a separate computation unit which then performs the actual processing.

It is possible to make the recordings and perform the actual processing in different locations. For instance, three independent devices with one microphone can be used which then transmit their respective signals to a separate processing unit (e.g., server), which then performs the actual conversion to multi-channel signals.

It is possible to create the multi-channel signal using only directional information, i.e., the side signal is not used at all. Alternatively, it is possible to create a multichannel signal using only the ambiance component, which might be useful if the target is to create a certain atmosphere without any specific directional information.

Numerous different panning methods can be used instead of one presented in equation (25).

There many alternative implementations for gain preprocessing in connection of mid signal processing.

In equation (14), it is possible to use individual delay and scaling parameters for every channel.

Many other output formats than 5.1 can be used. In the other output formats, the panning and channel decorrelation equations have to be modified accordingly.

Alternative Implementations with More or Fewer Microphones

Above, it has been assumed that there is always an input signal from three microphones available. However, there are possibilities to do similar implementations with different numbers of microphones. When there are more than three microphones, the extra microphones can be utilized to confirm the estimated sound source directions, i.e., the correlation can be computed between several microphone pairs. This will make the estimation of the sound source direction more reliable. When there are only two microphones, typically one on the left and one on the right side, only the left-right separation can be performed for the sound source direction. However, for example when microphone capture is combined with video recording, a good guess is that at least the most important sound sources are in the front and it may make sense to pan all the sound sources to the front. Thus, some kinds of spatial recordings can be performed also with only two microphones, but in most cases, the outcome may not exactly match the original recording situation. Nonetheless, two-microphone capture can be considered as a special case of the instant invention.

Efficient 3D Audio Coding Techniques

What has been described above includes techniques for spatial audio capture, which use microphone setups with a small number of microphones. Processing and playback for both binaural (headphone surround) and for multichannel (e.g., 5.1) audio were described. Both of these inventions use a two-channel mid (M) and side (S) audio representation, which is created from the microphone inputs. Both inventions also describe how the two-channel audio representation can be rendered to different listening equipment, headphones for binaural signals and 5.1 surround for multi-channel signals.

Transmitting surround sound as a 5.1 signal or as binaural signal is problematic because those types of signals can only be played back on a fixed loudspeaker setup. Transmitting surround sound in a flexible audio format allows the sound to be rendered to any loudspeaker setup. Examples of flexible audio formats are the mid/side two channel format described above or for example Dolby Atmos.

Transmitting the side (S) signal or other 1 to N channel ambient signals to the receiver takes some information and corresponding bandwidth. If the number of bits of information can be reduced, then more signals can be transmitted in the same network. Consequently, there are fewer breakups when live streaming video/audio and more video/audio can be stored to a mobile device.

Figure 15:
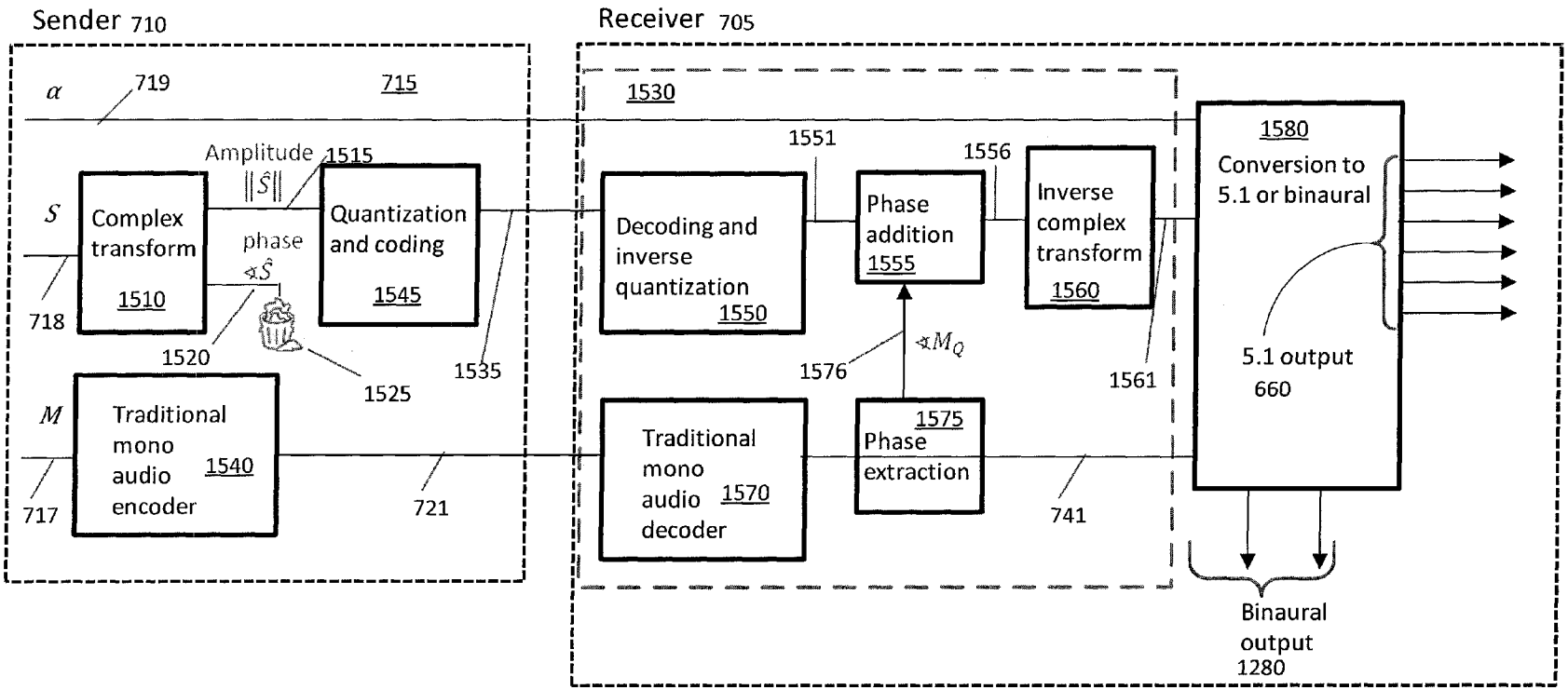
FIG. 15 is a block diagram/flowchart of an exemplary embodiment using mid and side signals and directional information for audio coding having reduced bit rate for ambient signals and decoding using same.
Figure 16:
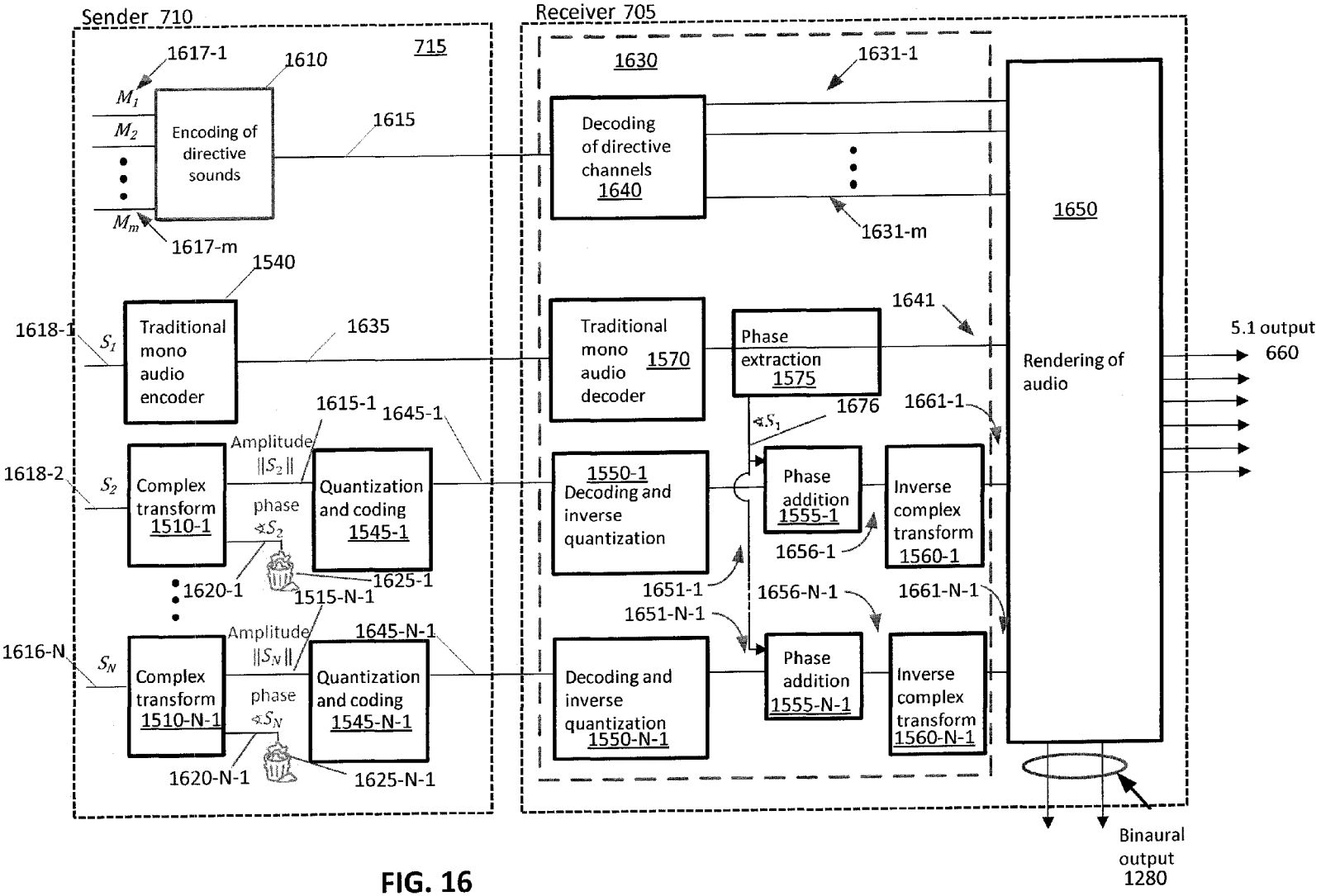
FIG. 16 is a block diagram/flowchart of an exemplary embodiment a proposed coding system with 2 to N channel ambient signals for audio coding having reduced bit rate for ambient signals and decoding using same.

Exemplary embodiments of the instant invention reduce the number of bits required to transmit ambient signals, e.g., because the phase information of the ambient signals is almost redundant, since the phase information may be randomized at a synthesis stage using, for instance, a decorrelation filter. Two main examples are presented herein. FIG. 15 is an example using the mid and side signals and directional information that have been previously described. FIG. 16 is an example using directive signals such as may be found, for instance, in Dolby Atmos and corresponding ambient signals.

Turning now to FIG. 15, a block diagram/flowchart is shown of an exemplary embodiment using mid and side signals and directional information for audio coding having reduced bit rate for ambient signals and decoding using same. FIG. 15 may be considered to be a block diagram of a system, as the sender (electronic device 710 in this example) and receiver (electronic device 705 in this example) have been shown in FIG. 7. The elements in the sender 710 may be performed by computer readable code stored in the one or more memories 620 (see FIG. 7) and executed by the one or more processors 615, which cause the electronic device 710 to perform the operations described herein. Similarly, the elements in the receiver 705 may be performed by computer readable code stored in the one or more memories 620 (see FIG. 7) and executed by the one or more processors 615, which cause the electronic device 705 to perform the operations described herein. FIG. 15 may also be considered to be a flowchart, since the blocks represent operations performed and the figure presents an order in which the blocks are performed.

The sender 710 in this example includes an encoder 715, which includes a complex transform function 1510, a quantization and coding function 1545, and a traditional mono audio encoder function 1540. The receiver 705 includes a decoder 1530, which includes a decoding and inverse quantization function 1550, a phase addition function 1555, an inverse complex transform function 1560, a traditional mono audio decoder function 1570, and a phase extraction function 1575. The receiver 705 also includes a conversion to 5.1 or binaural output function 1580.

The number of bits required to transmit the side (S) signal 718 can be reduced approximately by half. This can be performed by taking into account that in the synthesis process where the mid (M) 717 and side (S) 718 signals are converted into 5.1 or binaural signals as explained above, the phase information of the side (S) signal 718 is practically randomized by the decorrelation process. This makes the phase information redundant and therefore the phase information does not need to be transmitted to the receiver 705. In practice, a completely random phase would cause audible distortion, but it is possible to use the phase from the mid (M) signal 717 instead because the mid (M) 717 and side (S) 718 signals are created from the same microphone signals and therefore the (M) 717 and (S) 718 signals are correlated.

In addition to the mid (M) and side (S) signals, the direction ($\alpha$) of the dominant sound source needs to be transmitted to the receiver in order to be able to convert the (M) and (S) signals into 5.1 or binaural signals. The calculation of ($\alpha$) is explained above. For instance, see Equations (1) to (12), where the direction per subband is illustrated as $\alpha_b$. In the example shown in FIG. 15, no encoding/quantization of the directions 719 is shown. However, possible encoding schemes for $\alpha_b$ are described above in reference to FIG. 7.

With regard to the complex transform function 1510, an example of a suitable complex transform is presented in L. Mainard, P. Philippe: "The Modulated Phasor Transforms", 99th AES convention, preprint 4089, New York 1995. This transform allows critical sampling with overlapping windows and complex transform domain representation. The complex transform function 1510 creates an amplitude signal 1515 and a phase signal 1520. The phase signal 1520 is discarded, as illustrated by the trashcan 1525. The amplitude signal 1515 is quantized and coded via the quantization and coding function 1545 to create a coded side (amplitude only) signal 1535. The coding can include, as non-limiting examples, AMR-WB+, MP3, AAC and AAC+. A normal side signal may be coded down to, e.g., 96 kbps and without the phase information the side signal could be, e.g., 48 kbps. The quantization typically would be adaptive, so it is not possible to provide an exact number of quantization levels. The coding, including quantization, could be exactly as the coding is performed in MP3 or AAC except that the transforms would be changed to a Modulated Phasor Transform as above. That is, instead of MP3's hybrid filter bank or AAC's MDCT (Modified discrete cosine transform), the Modulated Phasor Transform would be used. Alternatively, DFT (Discrete Fourier Transform) may be used, however, DFT with overlapping windows is not critically sampled and is thus not an optimal choice.

The traditional mono audio encoder function 1540 may use any of the following codes: AMR-WB+, MP3, AAC and AAC+. In the example herein AAC is used, where AAC is defined in the following: "ISO/IEC 14496-3:2001(E), Information technology—Generic coding of moving pictures and associated audio information—Part 7: Advanced Audio Coding (AAC)". The encoder function 1540 creates the encoded mid signal 721. The signals 719, 1535, and 721 may be communicated through a network 725, as shown in FIG. 7.

The receiver 705 receives the encoded side signal 1535 and applies the decoding and inverse quantization function 1550 to the signal 1535 to create a decoded side (amplitude) signal 1551. Meanwhile, the traditional mono audio decoder function 1570 is applied to the encoded mid signal 721 to create a decoded mid signal 741. The phase extraction function 1575 operates on the decoded mid signal 741 to create phase information 1576, which is applied by the phase addition function 1555 to the side (amplitude only) signal 1551 to create a "combined" signal 1556 that has both amplitude (from signal 1551) and phase (from signal 1576). It is noted that the Q subscript for the phase information 1576 denotes the quantization process in the encoder. That is, since the mid (M) signal goes through the traditional mono audio encoder 1540 and the traditional mono audio decoder 1570, these introduce a quantization error to the M signal.

The phase extraction performed in 1575 may be performed as follows. The Modulated Phasor Transform from the Mainard paper cited above is applied to the decoded time-domain mid signal 741. The phase information is copied from that application and combined with the side signal 1551 after the side signal is decoded by phase addition function 1555, thereby creating the combined signal 1556.

An inverse complex transform function 1560 is applied to the combined signal 1556 to create a (e.g., decoded) side signal 1561. A suitable inverse complex transform that may be used is described by the Mainard paper cited above. While the Mainard paper does not present the inverse complex transform explicitly, the inverse complex transform is in the paper implicitly, as the transform is the transpose of the forward transform matrix, which follows from the property of being an orthogonal transform.

The conversion to 5.1 or binaural function 1580 could select (e.g., via user input) conversion to 5.1 channel output 660 or conversion to two channel binaural output 1280 and then execute a corresponding selected one of the multi-channel processing unit 1250 (see FIG. 12) or the binaural processing unit 625 (see FIG. 12). In this example, the multi-channel processing unit 1250 performs the actions in, e.g., blocks 10C to 10J of FIG. 10 using the directions 719, side signal 1561, and mid signal 741. The binaural processing unit 625 processes the directions 719, side signal 1561, and mid signal 741 to create the two-channel output audio signals 1280. For instance, the binaural processing unit 625 could perform, e.g., the actions in FIGS. 4 and 5 above using the directions 719, side signal 1561, and mid signal 741. It is noted in this example that the division into the two units 1250, 625 is merely exemplary, and these may be further subdivided or incorporated into a single function.

Example Embodiment with 2 to N Channel Ambient Signals

FIG. 16 is an example using directive signals such as may be found, for instance, in Dolby Atmos and corresponding ambient signals. FIG. 16 may be considered to be a block diagram of a system, as the sender (electronic device 710 in this example) and receiver (electronic device 705 in this example) have been shown in FIG. 7. The elements in the sender 710 may be performed by computer readable code stored in the one or more memories 620 (see FIG. 7) and executed by the one or more processors 615, which cause the electronic device 710 to perform the operations described herein. Similarly, the elements in the receiver 705 may be performed by computer readable code stored in the one or more memories 620 (see FIG. 7) and executed by the one or more processors 615, which cause the electronic device 7050 to perform the operations described herein. FIG. 16 may also be considered to be a flowchart, since the blocks represent operations performed and the figure presents an order in which the blocks are performed.

In FIG. 16, the sender 710 includes an encoder 715, which includes an encoding of directive sounds function 1610, the traditional mono audio encoder 1540 (also shown in FIGS. 15), and N-1 complex transform functions 1510 and corresponding N-1 quantization and coding functions 1545. The encoding of directive sounds function 1610 produces an output signal 1615 from the directive sounds 1617. In this example, the output signal 1615 is a single bitstream, but this is merely exemplary and the output signal 1615 may comprise multiple bitstreams if desired. The signal S is an N channel signal 1618. The signal 1618-1 passes through the traditional mono audio encoder 1540, which creates an encoded signal 1635. The other N-1 signals 1618-2 to 1618-N pass through corresponding complex transform functions 1510-1 to 1510-N-1, respectively. Each of the N-1 complex transform functions 1510 produces a corresponding amplitude signal 1615 and corresponding phase signal 1620, and the phase signal 1620 is discarded, as illustrated by a corresponding trashcan 1625. The resultant signals 1645-1 to 1645-N-1 contain amplitude information but not phase information. The signals 1615, 1635 and 1645 may be communicated over a network, as shown in FIG. 7 for instance and network 725.

The receiver 705 includes a decoder 1630 and a rendering of audio function 1650 that produces either 5.1 output 660 or binaural output 1280. It should be noted that both outputs 660 and 1280 may be produced at the same time, although it is unlikely both outputs would be needed at the same time. The decoder 1630 includes a decoding of directive channels function 1640, the traditional mono audio decoder 1570, a phase extraction function 1575, and N-1 decoding and inverse quantization functions 1550 with corresponding N-1 phase addition functions 1555 and inverse complex transform functions 1560. The decoding of directive channels function 1640 operates on the output signal 1635 to produce m signals 1631. The encoded signal 1640 is operated on by the traditional mono audio decoder 1570 to create a decoded signal 1641. Each of the N-1 decoding and inverse quantization functions 1550 produces a decoded (amplitude) signal 1651. The phase extraction function 1575 operates on the decoded signal 1641 to create phase information 1676, which is applied by each phase addition function 1555 to the decoded (amplitude only) signal 1651 to create a corresponding signal 1656 that has both amplitude (from signal 1651) and phase (from signal 1676). It is noted that the quantization above with respect to the phase information 1576 is also applicable to the phase information 1676. That is, since the first channel $S_1$ 1618-1 goes through the traditional mono audio encoder 1540 and the traditional mono audio decoder 1570, these introduce a quantization error to the first channel signal. FIG. 16 does not, however, use a Q to indicate this quantization error for the phase information 1656. Each inverse complex transform function 1560 is applied to a corresponding signal 1656 to create an ambient signal 1661. An inverse complex transform function 1560 was described above.

The rendering of audio function 1650 then selects (e.g., under direction of a user) either 5.1 channel output 660 or binaural output 1280 and performs the appropriate processing to convert the signals 1631, 1641, and 1661 to corresponding 5.1 channel output 660 or binaural output 1280. For the rending of binaural output, directive channels may be mapped into a space and then these channels are filtered with HRTF filters corresponding to the direction when binaural signal is desired. If multichannel loudspeaker signals are desired, then the directive channels are panned. An example of panning to 5.0 was provided above using a mid channel. Ambient channels are decorrelated and played back from all loudspeakers, similarly to what is done to side channels.

A more particular example is now provided. In systems like Dolby Atmos, there will most likely be a possibility to use ambient signals. These can be, e.g., rain sound that has been recorded in 5.0 (Low-frequency effect channel signals are most likely separate). Significant bit rate savings can be had if the phase information is transmitted for only one of the channels. For example this could be the first channel, as is shown in FIG. 16.

As illustrated by FIG. 16, S is an N channel 1618 ambient sound. $M_{i,\ i=1,\ldots,m}$ 1617 are one channel directive sounds. S is rain, recorded in 5.0 surround sound and $M_1$ 1617-1 is a passing car and $M_2$ 1617-2 is a person talking. Each of the three sounds is encoded and sent to a receiver. The receiver decodes these three sounds and then renders them to the user. Each of the two directive sounds ($M_1$ and $M_2$) is encoded in an example with mono AAC, via the encoding of directive sounds function 1610, which produces encoded output 1615. Traditionally, the 5.0 surround rain sound would be encoded with multichannel AAC. Instead, in FIG. 16, the first channel $S_1$ 1618-1 is encoded with a mono AAC encoder and the remaining four channels ($S_2$ 1618-2 to $S_5$ 1618-5) are encoded with a special encoder. The special encoder uses a complex transform as described above. The complex transform transforms the real input data into complex values with amplitude (in amplitude signals 1515) and phase (in phase signals 1520). The phase information in phase signals 1520-1 to 1520-N-1 (corresponding to channels $S_2$ 1618-2 to $S_5$ 1618-5) is discarded and only the amplitudes in amplitude signals 1515-1 to 1515-N-1 are sent for the receiver. In the receiver 705, the missing phase information is recreated by copying the phase from the received channel $S_1$ and adding the phase via the phase addition functions 1555 to the amplitudes in the decoded (amplitude only) signals 1651.

Other codecs can be used and additional sound signals can be present.

In FIGS. 15 and 16, decorrelating may be performed after the inverse complex transform 1560. For FIG. 16, the decorrelating may be performed to all of the ambient signals including the signals $S_1$ 1641 (after the decoder 1570) and 1661-1 to 1661-N-1 (after a corresponding one of the inverse complex transform functions 1560-1 to 1560-N). The decorrelation function can be as described above (see Equations 20 or 32) or as an example embodiment as follows: Let the signal to be decorrelated be x. It is divided into small 50% (percent) overlapping blocks b of size 2N:

$$x_b=[x(b*N),x(b*N+1),\ldots,x(b*N+2N-1)],b=0,1,2, \tag{35}$$

and windowed (typically 20 ms blocks). The window function is typically:

$$w_n=\sin\left(\frac{\pi}{2N}\left(n+\frac{1}{2}\right)\right),\quad n=0,\ldots,2N-1, \tag{36}$$

where 2 N is the length of a block in samples. The windowed blocks are transformed into frequency domain using FFT:

$$X_b=FFT(x_b) \tag{37}$$

In the frequency domain, the signal is decorrelated by adding a value $a_k$, k=0, . . . , N-1 to each of its phase components. The values $a_k$ remain the same for all blocks. As an example the values $a_k$ can be chosen randomly from the interval [0 . . . 2π).

$$\measuredangle\hat{X}_b(k)=\measuredangle X_b(k)+a_k \tag{38}$$

The decorrelated signal is inverse transformed and windowed.

$$\hat{x}_b=IFFT(\hat{X}_b)*w \tag{39}$$

The windowed, inverse transformed, decorrelated blocks are overlap added (i.e., overlapped and added) to form the decorrelated time domain signal:

$$\begin{cases} y_b(k)=\hat{x}_b(k)+\hat{x}_{b-1}(k+N),\ k=0,\ldots,N-1 \\ y_b(k)=\hat{x}_b(k)+\hat{x}_{b+1}(k-N),\ k=N,\ldots,2N-1 \end{cases} \tag{40}$$

$$y=[y_1,y_2,y_3,\ldots] \tag{41}$$

Without in any way limiting the scope, interpretation, or application of the claims appearing below, a technical effect of one or more of the example embodiments disclosed herein is to provide effective methods for compressing 5.1 channel or binaural content by coding only one channel completely and the magnitude information of the other channel, resulting in significant savings in the total bit rate. The exemplary embodiments of the invention help make possible streaming and storing advanced flexible audio formats like Dolby Atmos in mobile devices with limited storage capacity and downlink speed.

Figure 17:
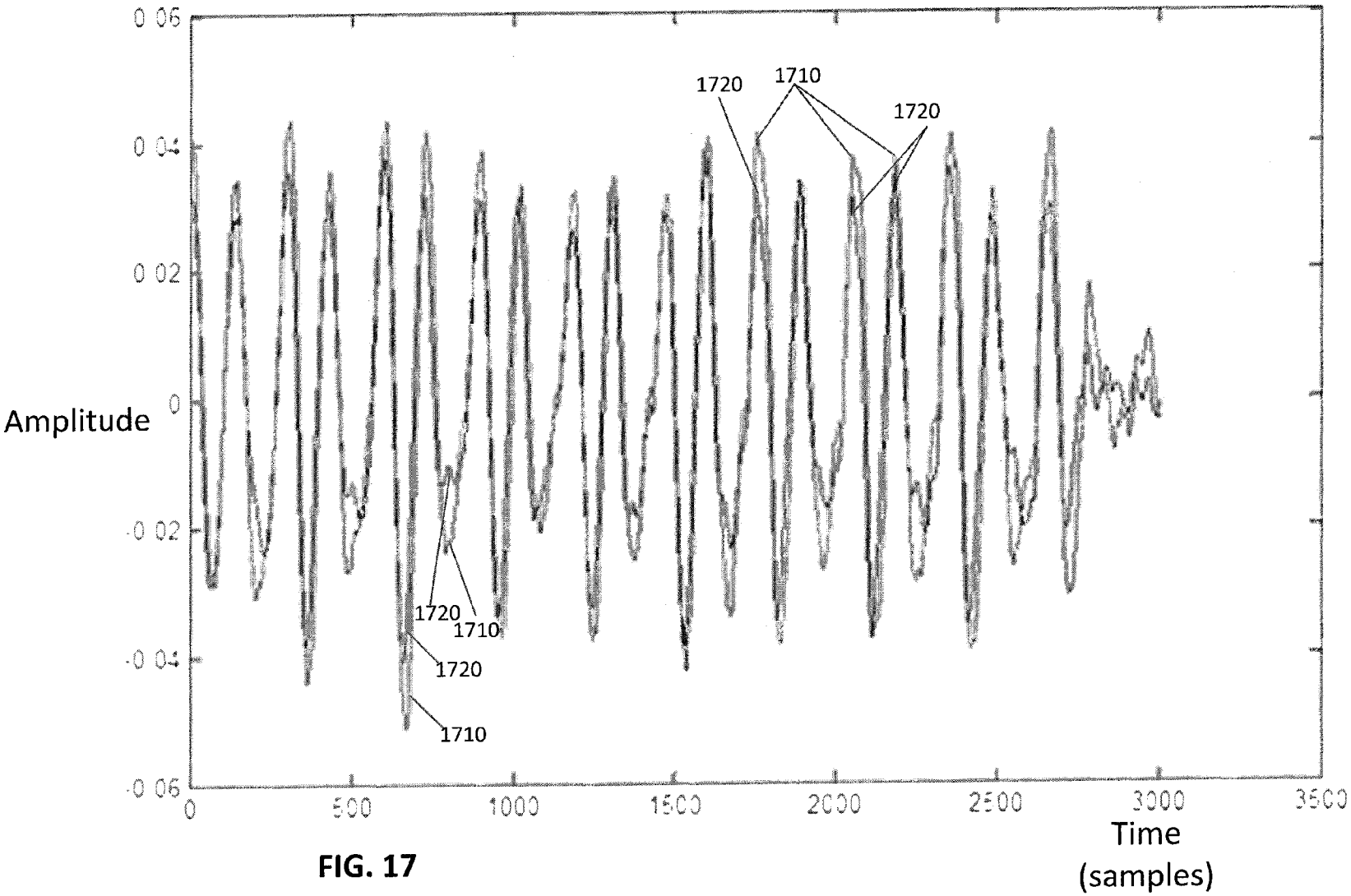
FIG. 17 is an excerpt of signals with original phase and copied phase after decorrelation.

FIG. 17 shows an excerpt of signals with original phase (1710) and copied phase after decorrelation (1720). One can see that the difference is rather small, and only certain locations on the chart are illustrated. Listening tests have proven that the difference is audible but not disturbing. The spatial image is perceived to be slightly different but not worse and there is no degradation to other aspects of audio quality.

Embodiments of the present invention may be implemented in software, hardware, application logic or a combination of software, hardware and application logic. In an exemplary embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with examples of computers described and depicted. A computer-readable medium may comprise a computer-readable storage medium that may be any media or means that can contain or store the instructions for use by or in connection with an instruction execution system, apparatus, or device, such as a computer.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. An apparatus, comprising:

one or more processors; and one or more memories including computer program code, the one or more memories and the computer program code configured, with the one or more processors, to cause the apparatus at least to:

create one or more first data streams by processing one or more first audio signals from at least a first microphone and a second microphone receiving an acoustic signal from a sound source, wherein the at least the first microphone and the second microphone receive the acoustic signal at a respective time dependent on a corresponding distance of each microphone from the sound source and the one or more audio signals contain a directional component of the acoustic signal dependent on the corresponding distance of each microphone from the sound source;

create one or more second data streams by processing one or more second audio signals from the at least the first microphone and the second microphone receiving the acoustic signal from the sound source, wherein the processing of the one or more second audio signals comprising detecting phase information from at least one of the one or more second audio signals, wherein the one or more second audio signals contain an ambient component of the acoustic signal, and wherein at least one of the one or more second data streams are created without the phase information to remove at least a portion of phase information from the ambient component from said at least one of the one or more second data streams to reduce a number of data bits required to transmit the ambient component of the acoustic signal; and output the one or more first data streams and the one or more second data streams, wherein the output includes a representation of the acoustic signal dependent on the directional component and the ambient component.

2. The apparatus of claim 1, wherein:

the one or more first audio signals is a single first audio signal;

the one or more first data streams is a single first data stream;

the one or more second audio signals is a single second audio signal;

the one or more second data streams is a single second data stream; and the single second data streams is created without the phase information from the single second audio signal.

3. The apparatus of claim 2, wherein detecting phase information from the single second audio signal further comprises performing a transform on the single second audio signal to create amplitude information and the phase information and wherein the single second data stream is created without the phase information from the single second audio signal by discarding the phase information but keeping the amplitude information.

4. The apparatus of claim 2, wherein the single first audio signal comprises a dominant sound source for each of a plurality of subbands, and wherein the single second audio signal comprises ambient sound for each of the plurality of subbands.

5. The apparatus of claim 4, wherein the one or more memories and the computer program code are configured, with the one or more processors, to cause the apparatus to output the one or more first data streams and the one or more second data stream by outputting a direction of a dominant sound source for each of the plurality of subbands.

6. The apparatus of claim 1, wherein:

the one or more first audio signals comprise a plurality of first audio signals;

the one or more second audio signals comprise a plurality of second audio signals; and the processing the one or more second audio signals further comprises detecting phase information from all but a selected one of the plurality of second audio signals, wherein the one or more second data streams are created without the phase information from each of the plurality of the second audio signals other than the selected second audio signal.

7. The apparatus of claim 6, wherein detecting phase information further comprises for each of the plurality of the second audio signals other than the selected second audio signal, performing a transform on the other second audio signal to create an amplitude information and the phase information of the other second audio signal, wherein the one or more second data streams are created without the phase information by discarding the phase information but keeping the amplitude information from each of the plurality of the second audio signals other than the selected second audio signal.

8. The apparatus of claim 7, wherein the one, or more memories and the computer program code are configured, with the one or more processors, to cause the apparatus to create the one or more second data streams by coding the selected second audio signal and coding each of the other second audio signals.

9. The apparatus of claim 6, wherein each of the plurality of first audio signals comprises the directional component and wherein each of the plurality of second audio signals comprises the ambient component.

10. The apparatus of claim 6, wherein the one or more memories and the computer program code are configured, with the one or more processors, to cause the apparatus to create the one or more first data streams by one of creating a single first data stream or creating a plurality of first data streams, wherein the one or more memories and the computer program code are configured, with the one or more processors, to cause the apparatus to create the one or more second data streams by one of creating a single second data stream or creating a plurality of second data streams.

11. A method, comprising:

creating one or more first data streams by processing one or more first audio signals from at least a first microphone and a second microphone receiving an acoustic signal from a sound source, wherein the at least the first microphone and the second microphone receive the acoustic signal at a respective time dependent on a corresponding distance of each microphone from the sound source and the one or more audio signals contain a directional component of the acoustic signal dependent on the corresponding distance of each microphone from the sound source;

creating one or more second data streams by processing one or more second audio signals from the at least the first microphone and the second microphone receiving the acoustic signal from the sound source, the processing of the one or more second audio signals comprising detecting phase information from at least one of the one or more second audio signals, wherein the one or more second audio signals contain an ambient component of the acoustic signal, and wherein the one or more second data streams are created without the phase information from the at least one second audio signal to remove at least a portion of phase information from the ambient component from said at least one of the one or more second data streams and reduce a number of data bits required to transmit the ambient component of the acoustic signal; and outputting the one or more first data streams and the one or more second data streams, wherein the output includes a representation of the acoustic signal dependent on the directional component and the ambient component.

12. The method of claim 11, wherein:

the one or more first audio signals is a single first audio signal;

the one or more first data streams is a single first data stream;

the one or more second audio signals is a single second audio signal;

the one or more second data streams is a single second data stream; and the single second data streams is created without the phase information from the single second audio signal.

13. The method of claim 12, wherein detecting phase information from the single audio signal further comprises performing a transform on the single second audio signal to create an amplitude information and the phase information and wherein the single second data stream is created without the phase information from the single second audio signal by discarding the phase information but keeping the amplitude information.

14. The method of claim 12, wherein the single first audio signal comprises a dominant sound source for each of a plurality of subbands, and wherein the single second audio signal comprises ambient sound for each of the plurality of subbands.

15. The method of claim 14, wherein the one or more memories and the computer program code are configured, with the one or more processors, to cause the apparatus to output the one or more first data streams and the one or more second data stream by outputting a direction of a dominant sound source for each of the plurality of subbands.

16. The method of claim 11, wherein:

the one or more first audio signals comprise a plurality of first audio signals;

the one or more second audio signals comprise a plurality of second audio signals; and the processing the one or more second audio signals further comprises detecting phase information from all but a selected one of the plurality of second audio signals, wherein the one or more second data streams are created without the phase information from each of the plurality of the second audio signals other than the selected second audio signal.

17. The method of claim 16, wherein detecting phase information further comprises for each of the plurality of the second audio signals other than the selected second audio signal, performing a transform on the second audio signal to create an amplitude information and the phase information of the other second audio signal, wherein the one or more second data streams are created without the phase information by discarding the phase information but keeping the amplitude information from each of the plurality of the second audio signals other than the selected second audio signal.

18. The method of claim 17, wherein the one or more second data streams are created by coding the selected second audio signal and coding each of the other second audio signals.

19. The method of claim 16, wherein each of the plurality of first audio signals comprises the directional component and wherein each of the plurality of second audio signals comprises the ambient component.

20. The method of claim 16, further wherein the one or more first data streams are created by one of creating a single first data stream or creating a plurality of first data streams, wherein the one or more second data streams are created by one of creating a single second data stream or creating a plurality of second data streams.

21. A computer program product embodied in a non-transitory computer memory and comprising instructions the execution of which by a processor results in performing operations that comprise:

creating one or more first data streams by processing one or more first audio signals from at least a first microphone and a second microphone receiving an acoustic signal from a sound source, wherein the at least the first microphone and the second microphone receive the acoustic signal at a respective time dependent on a corresponding distance of each microphone from the sound source and the one or more audio signals contain a directional component of the acoustic signal dependent on the respective distance of each microphone from the sound source;

creating one or more second data streams by processing one or more second audio signals from the at least the first microphone and the second microphone receiving the acoustic signal from the sound source, the processing of the one or more second audio signals comprising detecting phase information from at least one of the one or more second audio signals, wherein the one Or more second audio signals contain an ambient component of the acoustic signal, and wherein the one or more second data streams are created without the phase information from the at least one second audio signal to remove at least a portion of phase information from the ambient component from said at least one of the one or more second data streams and reduce a number of data bits required to transmit the ambient component of the acoustic signal; and outputting the one or more first data streams and the one or more second data streams, wherein the output includes a representation of the acoustic signal dependent on the directional component and the ambient component.

* * * * *